US006550285B2

(12) United States Patent
Nishitani

(10) Patent No.: US 6,550,285 B2
(45) Date of Patent: Apr. 22, 2003

(54) YARN FEEDING APPARATUS

(75) Inventor: Hirokazu Nishitani, Wakayama (JP)

(73) Assignee: Shima Seiki Manufacturing Limited, Wakayama (JP)

( * ) Notice: Subject to any disclaimer, the term of this patent is extended or adjusted under 35 U.S.C. 154(b) by 0 days.

(21) Appl. No.: 10/059,310

(22) Filed: Jan. 31, 2002

(65) Prior Publication Data

US 2002/0139152 A1 Oct. 3, 2002

(30) Foreign Application Priority Data

Jan. 31, 2001 (JP) ..... 2001-023087

(51) Int. Cl.[7] ..... D04B 15/48
(52) U.S. Cl. ..... 66/146; 66/125 R
(58) Field of Search ..... 66/125 R, 126 R, 66/146, 210, 211, 213; 226/44, 45; 242/416, 418.1

(56) References Cited

U.S. PATENT DOCUMENTS

| | | | | |
|---|---|---|---|---|
| 3,858,416 A | * | 1/1975 | White et al. | 66/132 R |
| 4,720,985 A | * | 1/1988 | Goller et al. | 66/132 R |
| 4,752,044 A | | 6/1988 | Memminger et al. | |
| 4,942,908 A | * | 7/1990 | Imamura | 139/1 E |
| 4,966,333 A | * | 10/1990 | Bosch | 242/412.3 |
| 5,375,435 A | * | 12/1994 | Gille et al. | 66/209 |
| 5,421,534 A | * | 6/1995 | Arnold et al. | 226/42 |
| 6,010,052 A | | 1/2000 | Leins et al. | |

FOREIGN PATENT DOCUMENTS

| | | |
|---|---|---|
| DE | 1209236 | 1/1966 |
| DE | 3002311 A1 | 7/1981 |
| DE | 19537325 C1 | 11/1996 |
| DE | 19537215 A1 | 4/1997 |
| DE | 19756484 A1 | 6/1999 |
| EP | 0256519 | 2/1988 |
| JP | 2541574 | 7/1996 |
| JP | 11-500500 | 1/1999 |

* cited by examiner

*Primary Examiner*—Danny Worrell
(74) *Attorney, Agent, or Firm*—Wenderoth, Lind & Ponack, L.L.P.

(57) ABSTRACT

A fluctuation in tension of a knitting yarn to be fed is reduced, and the knitting yarn having an accurate length is fed even if the amount of demand for the knitting yarn is suddenly changed. A knitting yarn is interposed between a main roller and a driven roller and is thus fed, and is supplied from a yarn feeding port to a fabric, with storage depending on an inclination of a buffer rod. A yarn feeding controller predicts the amount of demand for the knitting yarn based on a signal sent from a knitting controller and PID controls a servo motor such that a position of a tip portion of the buffer rod aims for a position of an origin according to the inclination angle of the buffer rod, which angle is detected by an inclination angle sensor.

15 Claims, 17 Drawing Sheets

YARN FEEDING APPARATUS

BACKGROUND OF THE INVENTION

1. Field of the Invention

The present invention relates to a yarn feeding apparatus for feeding a knitting yarn, for knitting a fabric, to a weft knitting machine.

2. Description of the Related Art

Conventionally, a weft knitting machine 1 shown in FIGS. 24 and 25 has a yarn feeding apparatus 6 provided in a side cover 5 in order to feed a knitting yarn 4 to a yarn feeding port 3 when knitting a fabric 2. The yarn feeding apparatus 6 comprises a buffer rod 7 having a function of temporarily storing the knitting yarn 4, and a function of adding tension to the knitting yarn 4. The buffer rod 7 has a base end side 8 supported on the side cover 5 and can rock and displace a tip side 9 around the base end side 8. The tip side 9 of the buffer rod 7 pulls the knitting yarn 4 by virtue of a spring and is stabilized with energizing force of the spring balanced with a tensile force based on tension of the knitting yarn 4. A length measuring roller 10 serves to measure a length of the knitting yarn 4 to be fed from the yarn feeding apparatus 6 to the yarn feeding port 3. As a result of the measurement of the length of the knitting yarn 4, a stitch representing an amount of pull-in of a knitting needle pulled in through a carriage to knit the fabric 2 can be controlled such that an amount of consumption of the knitting yarn 4 is coincident with a predicted amount based on knitting data.

FIG. 24 shows a positional relationship of the yarn feeding port 3 in a state in which the carriage is moved toward the yarn feeding apparatus side of a needle bed in the weft knitting machine 1, and is then started to be moved away from the yarn feeding apparatus 6. FIG. 25 shows a state in which the carriage is moved to an end apart from the yarn feeding apparatus 6, and the yarn feeding port 3 is also moved over the fabric to an end on the side provided apart from the yarn feeding apparatus 6. In the weft knitting machine 1, an amount of demand for the knitting yarn 4 also fluctuates depending on the positional relationship of the yarn feeding port 3 with the fabric 2. In the conventional yarn feeding apparatus 6 in which the knitting yarn 4 is stored and tension is provided within an inclination of the buffer rod 7, the buffer rod 7 stores the knitting yarn 4 at a maximum with the yarn feeding port 3 reaching an end on the yarn feeding apparatus side of the fabric 2 as shown by a broken line of FIG. 24. When the knitting operation for a next course of the fabric 2 is started, the yarn feeding port 3 is moved in such a direction as to go away from the yarn feeding apparatus 6 by virtue of the carriage. Since the knitting yarn 4 is pulled, the inclination of the buffer rod 7 is reduced as shown by a solid line. As shown in FIG. 25, when the yarn feeding port 3 approaches the end of the fabric 2 on such a side as to go away from the yarn feeding apparatus 6, the amount of demand for the knitting yarn 4 is decreased and the inclination of the buffer rod 7 is increased again, as shown by a broken line, to pull in and store the knitting yarn 4 in a larger amount. The inclination of the buffer rod 7 corresponds to tension of the knitting yarn 4. In such a structure in which the inclination of the buffer rod 7 provides a tension and stores the knitting yarn 4, therefore, tension of the knitting yarn 4 fluctuates greatly during a middle of the knitting operation.

For example, Japanese Examined Patent Publication JP-B2 2541574 discloses conventional art in which tension is provided to a knitting yarn by using a member corresponding to the buffer rod 7 shown in FIGS. 24 and 25, and preliminary storage is carried out to cope with a sudden fluctuation, thereby suppressing a fluctuation in yarn tension while actively feeding a knitting yarn. Moreover, Japanese Unexamined Patent Publication JP-A 11-500500 (1999) aslo discloses conventional art in which rotation of a spinning wheel for feeding a knitting yarn is controlled prior to a sudden change in a demand for the yarn, thereby suppressing a fluctuation in yarn tension without using a member corresponding to the buffer rod 7 shown in FIGS. 24 and 25.

In the conventional yarn feeding apparatus 6 shown in FIGS. 24 and 25, the amount of demand for the knitting yarn 4 greatly fluctuates depending on a position of the yarn feeding port 3, and the yarn tension also fluctuates depending on the demand for the yarn by an operation for knitting the fabric 2 in the weft knitting machine 1. Also in conventional art, as described in the JP-B2 2541574, it is hard to cope with a sudden fluctuation in the amount of demand for yarn which results at the end of the fabric. In conventional art described in the JP-A 11-500500, it is expected that a countermeasure can be taken against a sudden fluctuation in the amount of demand for a knitting yarn. In this conventional art, however, it is necessary to wind the knitting yarn onto a spinning wheel. Therefore, a size of the spinning wheel is increased. In a weft knitting machine, a plurality of yarns are often used properly to knit a fabric so that a yarn feeding apparatus is to be provided for each yarn.

FIGS. 24 and 25 show that a precise amount of the knitting yarn 4 for the entire width of the fabric 2 is unknown even if the length of the knitting yarn 4, which has already been fed to the length measuring roller 10, is to be measured in order to feed the required knitting yarn 4 corresponding to knitting data of the fabric 2. More specifically, in FIG. 24 showing a data fetch starting position, it is possible to measure a precise length of the knitting yarn 4 only at a portion provided apart from the end of the fabric 2 by approximately several centimeters. In the case in which the buffer rod 7 is inclined from a state shown by a solid line to a state shown by a broken line, the amount of storage of the knitting yarn 4, which is increased with the inclination of the buffer rod 7, is also measured by virtue of the length measuring roller 10 so that the net amount of consumption of the knitting yarn 4 to be fed to the fabric 2 is unknown. Moreover, the amount of the knitting yarn 4 to be fed when the buffer rod 7 is returned from the state shown by the broken line to the state shown by the solid line cannot be directly measured by virtue of the length measuring roller 10. Also in FIG. 25 showing a data fetch ending position, the length of the knitting yarn 4 shown as a broken line is unknown. Also in the conventional art as described in JP-B2 2541574 and JP-A 11-500500, there is not disclosed a structure related to accurate measurement of the amount of demand for the knitting yarn.

SUMMARY OF THE INVENTION

It is an object of the invention to provide a yarn feeding apparatus capable of accurately feeding a knitting yarn, required for knitting, to a weft knitting machine while suppressing a change in tension against a sudden change in demand.

The invention provides a yarn feeding apparatus for feeding a knitting yarn to a yarn feeding port, depending on demand for the knitting yarn in a weft knitting machine, for knitting a fabric while moving the yarn feeding port in a direction of a width of the fabric, together with a knitting operation to be carried out by an advancing and retreating operation of a knitting needle based on knitting data. The yarn feeding apparatus comprises:

a main roller provided in a feeding path for the knitting yarn and partially coming into contact with the knitting yarn on a rotatable outer peripheral surface of the main roller;

a servo motor for rotating a rotary shaft of the main roller;

a driven roller for interposing the knitting yarn, in contact with the outer peripheral surface of the main roller, between the driven roller and the outer peripheral surface;

a driven mechanism for transmitting a driving force from the servo motor to rotate the driven roller at an equal circumferential speed interlockingly with respect to rotation of the main roller;

a buffer rod provided in a path through which the knitting yarn is to be fed, from a portion between the main roller and the driven roller, to the yarn feeding port of the weft knitting machine, wherein the buffer rod is capable of being rocked and displaced around a base portion thereof and serves to partially pull the knitting yarn from the path when a tip portion of the buffer rod is rocked and displaced toward one of two sides;

a spring for urging the buffer rod to one of the sides so as to pull the knitting yarn from the path by a predetermined length under a predetermined yarn tension;

a sensor for detecting a rocking and displacement state of the buffer rod, based on an origin of the tip portion of the buffer rod, when the knitting yarn is to be pulled from the path by the predetermined length, and for sending out a signal indicative of a result of the detection; and a control device for proportion, integration and differentiation (PID) control of the servo motor based on the signal sent by the sensor, wherein, before the knitting in the direction of the width of the fabric is to be started, the control device operates to supply a larger amount of the knitting yarn than that supplied when the tip portion of the buffer rod is positioned at the origin, carries out the PID control to include a differential component within a remainder side range from which a the tip portion is to be returned to a point corresponding to the origin when the knitting is started and demand for the knitting yarn is rapidly increased, and carries out the PID control so as not to include the differential component even if the the tip portion is placed on a remainder side or an insufficient side after the tip portion once passes through the point corresponding to the origin and is then transferred to an insufficient side range in which a length of the knitting yarn to be led out from the path is smaller than that to be led out when the tip portion is at the point corresponding to the origin.

According to the invention, the knitting yarn interposed between the main roller and the driven roller is fed to the yarn feeding port of the weft knitting machine. The knitting yarn is interposed between the driven roller and the main roller and is in partial contact with the outer peripheral surface of the main roller. The main roller is rotated by the servo motor. The rotating force of the servo motor is transmitted to the driven roller through the driven mechanism to be rotated at an equal circumferential speed relative to the speed of the rotation of the main roller. Since the knitting yarn is interposed between the main roller and the driven roller, having equal circumferential speeds, when the yarn is fed from between these rollers a force is not applied to the knitting yarn so that the knitting yarn can be supplied stably. The knitting yarn fed from between the main roller and the driven roller is led from the feeding path at the tip portion of the buffer rod. The buffer rod is urged by a spring such that the knitting yarn is led out by a predetermined length under a predetermined tension. The rocking and displacement state of the buffer rod is detected by virtue of the sensor, based on the origin to which the tip portion of the buffer rod is set at this time, and a signal representing the result of the detection is sent from the sensor to the control device. By such a control operation, an amount of the knitting yarn, larger than that supplied when the tip portion of the buffer rod is placed at the origin, is supplied before the knitting operation in the direction of the width of the fabric is started. The servo motor can be controlled by using the differential component for the PID control such that sufficient yarn is supplied corresponding to a sudden demand for the yarn in the case in which the tip portion of the buffer rod is set to the remainder side range apart from the point corresponding to the origin when the knitting operation is started and the demand for the knitting yarn is suddenly increased. After the tip portion of the buffer rod once passes through the point corresponding to the origin and is transferred to the insufficient side range, the differential component is not used for the PID control within both the remainder side range and the insufficient side range into which the tip portion is now located. Therefore, an oscillation can be prevented to stably carry out the control.

According to the invention, the servo motor can be controlled by using the differential component which can cope with a sudden increase in the demand for the knitting yarn at the start of the knitting operation, the knitting yarn required for the knitting can be supplied accurately, and furthermore, an oscillation can be prevented to stably carry out the control.

Moreover, the invention is characterized in that the control device PID controls the servo motor based on a change in position of the yarn feeding port with respect to the fabric and a change in amount of the knitting yarn which is calculated from the knitting data, such that the rocking and displacement state of the buffer rod is set within a predetermined range.

According to the invention, the control device PID controls the servo motor such that the rocking and displacement state of the buffer rod is set within the predetermined range. The control device can carry out control for pointing the knitting yarn such that the amount of feed of the knitting yarn is increased before the demand for the knitting yarn is actually increased, based on a change in position of the yarn feeding port with respect to the fabric and a change in amount of the knitting yarn which is calculated from the knitting data. The control for the pointing of the knitting yarn and the change in the rocking and displacement state of the buffer rod can operate such that the tension of the knitting yarn does not greatly fluctuate even if the knitting yarn is changed suddenly. The control is carried out such that the rocking and displacement state of the buffer rod is set within the predetermined range. Therefore, the amount of the knitting yarn to be led out by the buffer rod can be set within a constant range, the influence of the buffer rod on the amount of the knitting yarn to be fed to the fabric can be reduced, and the amount of feed of the knitting yarn can also be measured with high precision based on a driving state of the servo motor.

According to the invention, moreover, even if the amount of the demand for the knitting yarn fluctuates with the knitting operation of the fabric in the weft knitting machine, a fluctuation in yarn tension can be suppressed and the length of the knitting yarn to be fed to the fabric can be caused to correspond to the amount of the knitting yarn to be fed from the main roller with high precision.

Furthermore, the invention is characterized in that the control device carries out, with only the differential component, the PID control to include the differential component within the remainder side range, and carries out, with a proportion component and an integral component, the PID control to include no differential component.

According to the invention, although the proportion component is zero when the tip portion of the buffer rod passes through the point corresponding to the origin, the servo motor can be smoothly controlled by converting the differential component into the integral component to switch an output without a difference in speed.

According to the invention, moreover, tension of the knitting yarn can be properly controlled by continuously switching the PID control using only the differential component and the PID control using no differential component.

Furthermore, the invention is characterized in that the control device sets a gain into a high gain state having an excellent follow-up property while the tip portion of the buffer rod passes through the point corresponding to the origin from the remainder side range, first reaches a position in which an amplitude is maximum within the insufficient side range and returns to a predetermined range toward the point corresponding to the origin, and switches the gain into a low gain state having an excellent stability in such a position as to pass through the predetermined range and to return to the point corresponding to the origin.

According to the invention, the control can be carried out such that the state in which the gain of the control is high and the follow-up property is excellent is set in an early stage in which the knitting operation is started and the knitting yarn is started to be fed to the yarn feeding port, and the state in which the gain of the control is low and stable is set after an insufficient state of the knitting yarn is relieved and the tip portion of the buffer rod is started to be returned toward the point corresponding to the origin.

According to the invention, moreover, the state in which the gain of the control is high and the follow-up property is excellent can be set in the early stage of the knitting operation so that the insufficient state of the knitting yarn can be relieved rapidly. When the insufficient state of the knitting yarn can be relieved, the gain of the control can be decreased and stabilized.

Furthermore, the invention is characterized in that the control device carries out, in the high gain state, the PID control to include no differential component by setting, to be the insufficient side range, a range in which the tip portion of the buffer rod is first moved to the point corresponding to the origin from a position where a large amount of the knitting yarn is supplied before the knitting operation is started in place of the PID control to include the differential component by setting this range to be the remainder side range.

According to the invention, the control can be carried out such that the state in which the gain of the control is high and the follow-up property is excellent is set in the early stage in which the knitting operation is started and the knitting yarn is started to be fed to the yarn feeding port, and the state in which the gain of the control is low and stable is set after the insufficient state of the knitting yarn is relieved and the tip portion of the buffer rod is started to be returned toward the point corresponding to the origin.

According to the invention, moreover, it is possible to set the state in which the gain of the control is high and the follow-up property is excellent even if the knitting yarn is excessively pulled out after the knitting operation is started, thereby coping with a sudden increase in demand. When the insufficient state of the knitting yarn is relieved and the tip portion of the buffer rod is started to be returned toward the point corresponding to the origin, the control can be carried out such that the gain of the control is reduced and stability is enhanced.

Furthermore, the invention is characterized in that the control device carries out control for stopping rotation of the servo motor prior to such a time as to feed the knitting yarn to a knitting end where the knitting operation is completed on one of two sides in the direction of a width of the fabric such that the servo motor is actually stopped after the time to feed the knitting yarn to the knitting end, and a length of the knitting yarn to be reeled with an inclination of the buffer rod toward the insufficient side range before the knitting end is passed after a start of the control of the rotational stop is equivalent to a length of the knitting yarn to be stored by the return of the tip portion of the buffer rod to the point corresponding to the origin before the servo motor is actually stopped after the passage through the knitting end.

According to the invention, when the fabric which is being knitted reaches one of the knitting ends in the direction of the width, the knitting yarn is stopped from being until the knitting operation is subsequently started on the other side in the direction of the width. The rotation of the servo motor for feeding the knitting yarn cannot be carried out instantly but a constant time is required. Even if the servo motor is stopped when the position of the knitting yarn to be fed passes through the knitting end, the knitting yarn to be fed remains in a time taken to actually stop the servo motor and the buffer rod is rocked toward the point corresponding to origin to store the knitting yarn such that the feeding path for the knitting yarn can be prevented from being loosened.

According to the invention, moreover, sudden stop offset control for stopping the rotation of the servo motor is carried out prior to such a time that the knitting yarn is fed to the knitting end at which the knitting operation is completed on one of the sides of fabric in the direction of the width of the fabric. The servo motor which cannot be instantly transferred from a rotational state to a stopped state is actually stopped after the time to feed the knitting yarn to the knitting end is passed. By beginning stopping of the rotation of the servo motor before the knitting operation is completed, the knitting yarn can be prevented from being excessively fed before the servo motor is actually stopped. Before the knitting end is passed the control of the rotation stop is started, and the control is carried out such that the length of the knitting yarn to be reeled with the buffer rod inclined toward the insufficient side range is equivalent to the length of the knitting yarn to be stored by the return of the buffer rod toward the point corresponding to the origin before the servo motor is actually stopped after the passage through the knitting end. When the servo motor is finally stopped, therefore, the knitting yarn having a proper length can be stored in the buffer rod.

Moreover, the invention is characterized in that the control device carries out control to increase the amount of feed of the knitting yarn such that the tip portion of the buffer rod is set in the remainder side range apart from the point corresponding to the origin before a knitting operation for a next course is started when it is decided that the yarn feeding port leaves the knitting range in the direction of the width of the fabric based on a change in position of the yarn feeding port with respect to the fabric.

According to the invention, the knitting yarn can be stored up to the remaining range side on the tip portion side of the buffer rod in order to provide for a sudden increase in the demand for the yarn at the start of the knitting operation for one course of the fabric, and the control using the differential component within the remainder side range can be effective.

According to the invention, moreover, the amount of storage of the knitting yarn can be previously increased such that the control using the differential component is effective before the amount of the demand for the knitting yarn is suddenly increased.

Furthermore, the invention is characterized in that the control device carries out control to stop the servo motor when it is decided that the yarn feeding port is moved away from the knitting yarn feeding side with respect to the width of the fabric based on a change in position of the yarn feeding port with respect to the fabric, and that the position of an advancing and retreating operation of a knitting needle leaves an end of the width of the fabric based on the knitting data.

According to the invention, when the fabric is to be knitted over the side provided away from the yarn feeding side, tension of the knitting yarn can be maintained within a proper range without excessively feeding the knitting yarn.

According to the invention, moreover, the servo motor can be stopped to prevent the knitting yarn from being excessively fed during a stage in which the demand for the knitting yarn is eliminated.

Furthermore, the invention is characterized in that the control device calculates the amount of the knitting yarn for each knitting needle.

According to the invention, pointing control is carried out by calculating the amount of the knitting yarn for each knitting needle. Therefore, it is possible to reduce a fluctuation in tension applied to the knitting yarn when knitting the fabric.

According to the invention, moreover, it is possible to reduce a fluctuation in a yarn tension for each knitting needle to knit the fabric.

Furthermore, the invention is characterized in that the control device calculates the amount of the knitting yarn for plural knitting needles.

According to the invention, the amount of the knitting yarn is calculated for plural knitting needles. For example, therefore, it is possible to make the entire tension constant while changing the tension for each knitting needle, thereby making the best of a feature of the fabric for a knitting operation with a change in a regular amount of consumption of the yarn, for example, jacquard knitting.

According to the invention, moreover, it is possible to prevent the tension from being changed for plural knitting needles, thereby making the best of a feature of a pattern to be knitted.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
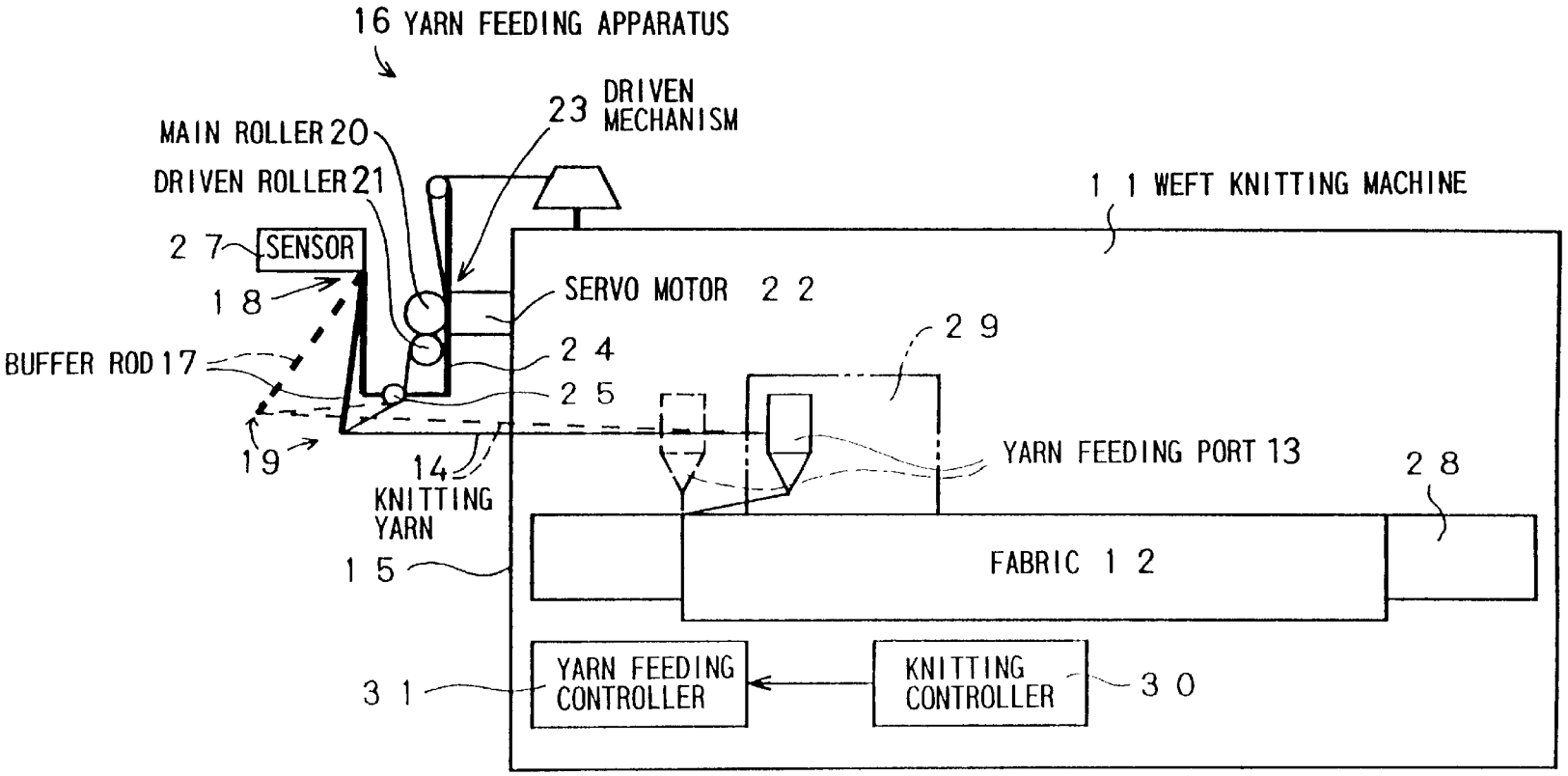
FIG. 1 is a block diagram showing a schematic structure according to an embodiment of the invention.

Now referring to the drawings, preferred embodiments of the invention are described below.

FIG. 1 shows a schematic structure of a weft knitting machine 11 comprising a yarn feeding apparatus according to an embodiment of the invention. The weft knitting machine 11 feeds a knitting yarn 14 from a yarn feeding port 13 to a knitting needle in order to knit a fabric 12. The knitting yarn 14 to be supplied to the yarn feeding port 13 suppresses a fluctuation in tension through the yarn feeding apparatus 16 provided in a side cover 15 of the weft knitting machine 11, and is supplied in a proper length corresponding to an amount of demand.

The yarn feeding apparatus 16 comprises a buffer rod 17 and a tip portion 19 is rocked and displaced around a base portion 18 so that the knitting yarn 14 having a certain length can be stored. The buffer rod 17 is urged by a spring in such a direction that the tip portion 19 moves away from a surface of the side cover 15, and is inclined to have an angle balanced with a tensile force based on tension of the knitting yarn 14. The yarn feeding apparatus 16 according to the embodiment predicts a fluctuation in an amount of demand for the knitting yarn 14 and carries out control to suppress a fluctuation in an inclination angle of the buffer rod 17, thereby preventing tension of the knitting yarn 14 from being changed.

Figure 2:
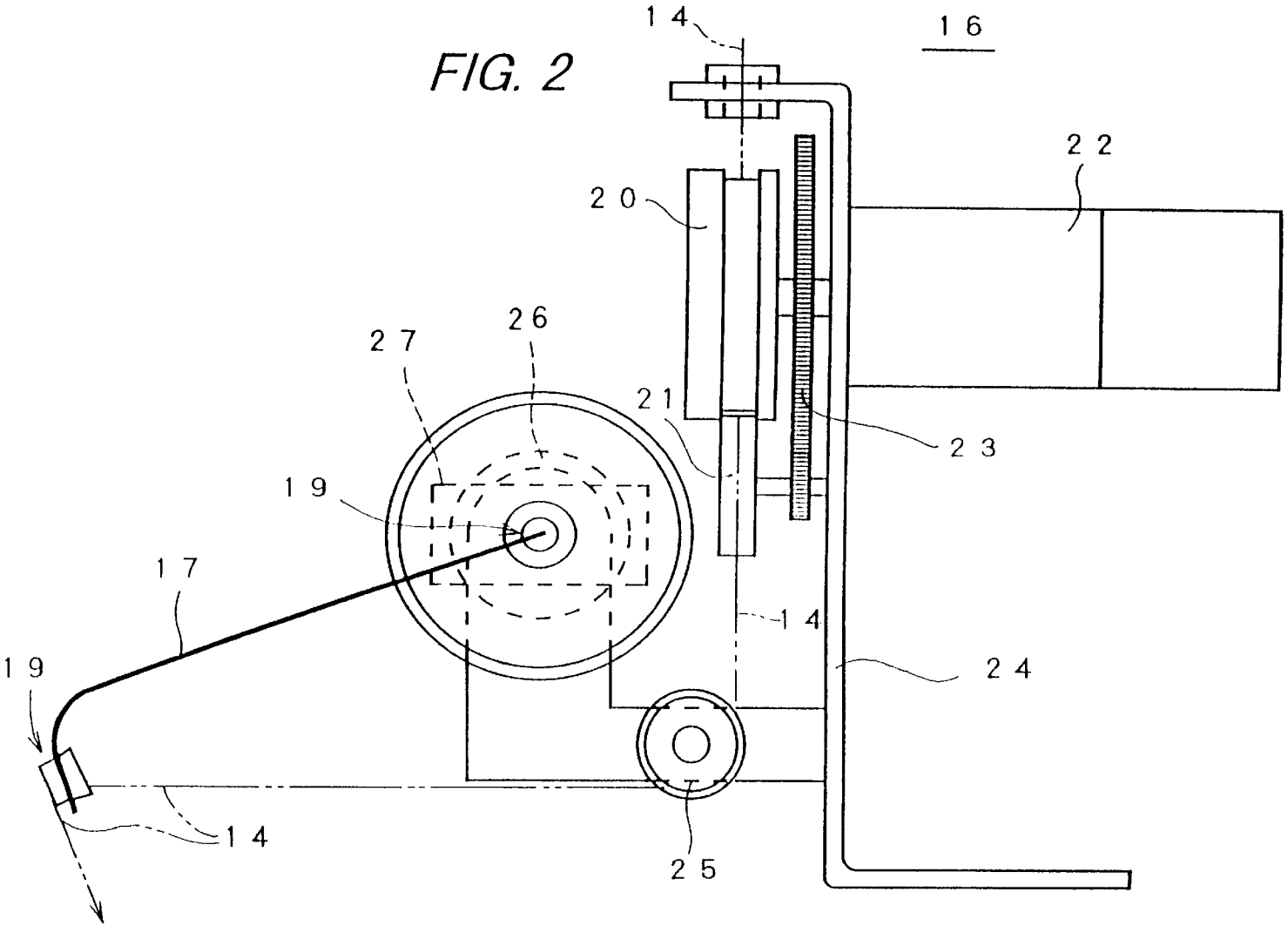
FIG. 2 is a front view showing a yarn feeding apparatus in FIG. 1.
Figure 3:
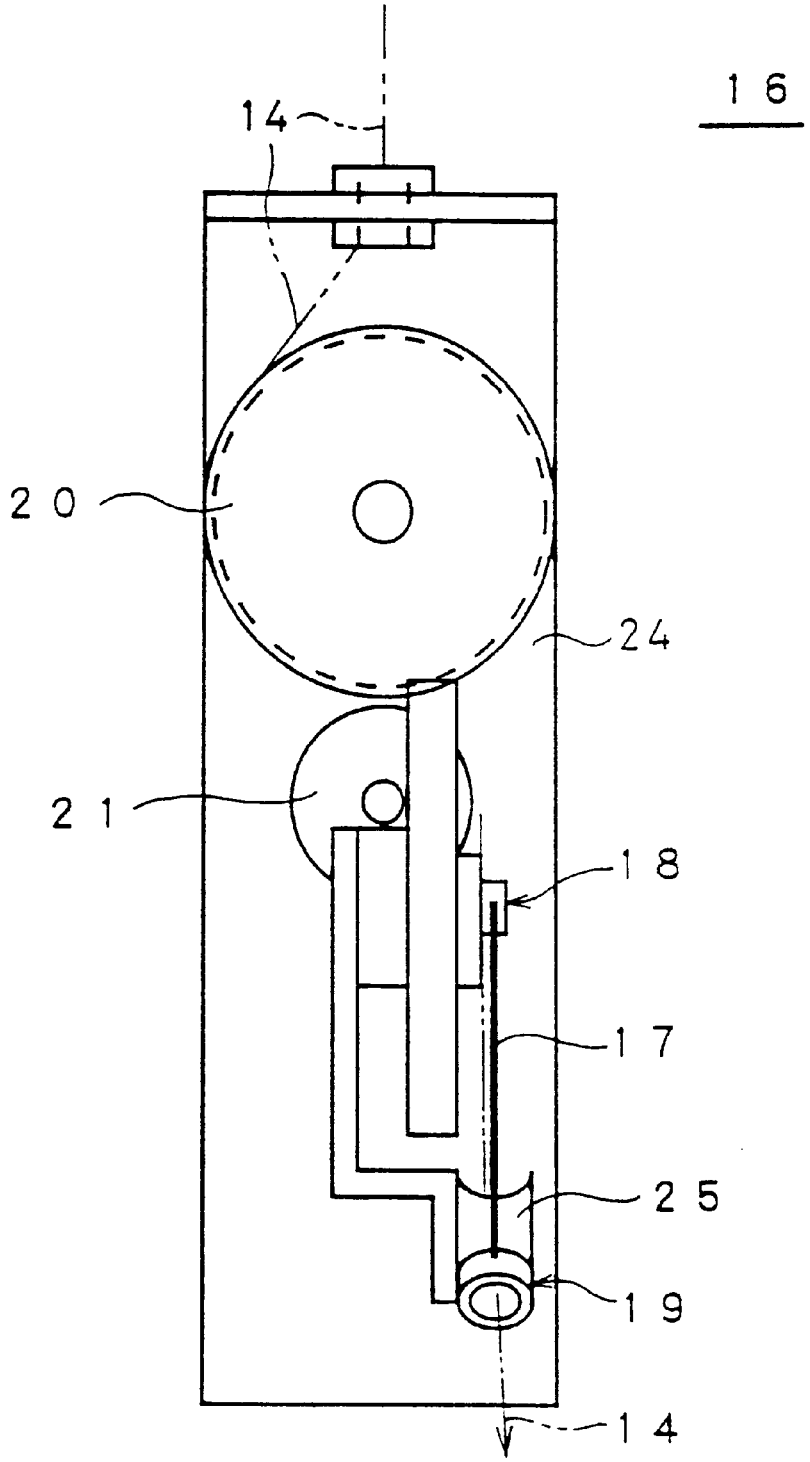
FIG. 3 is a left side view showing the yarn feeding apparatus in FIG. 1.
Figure 4:
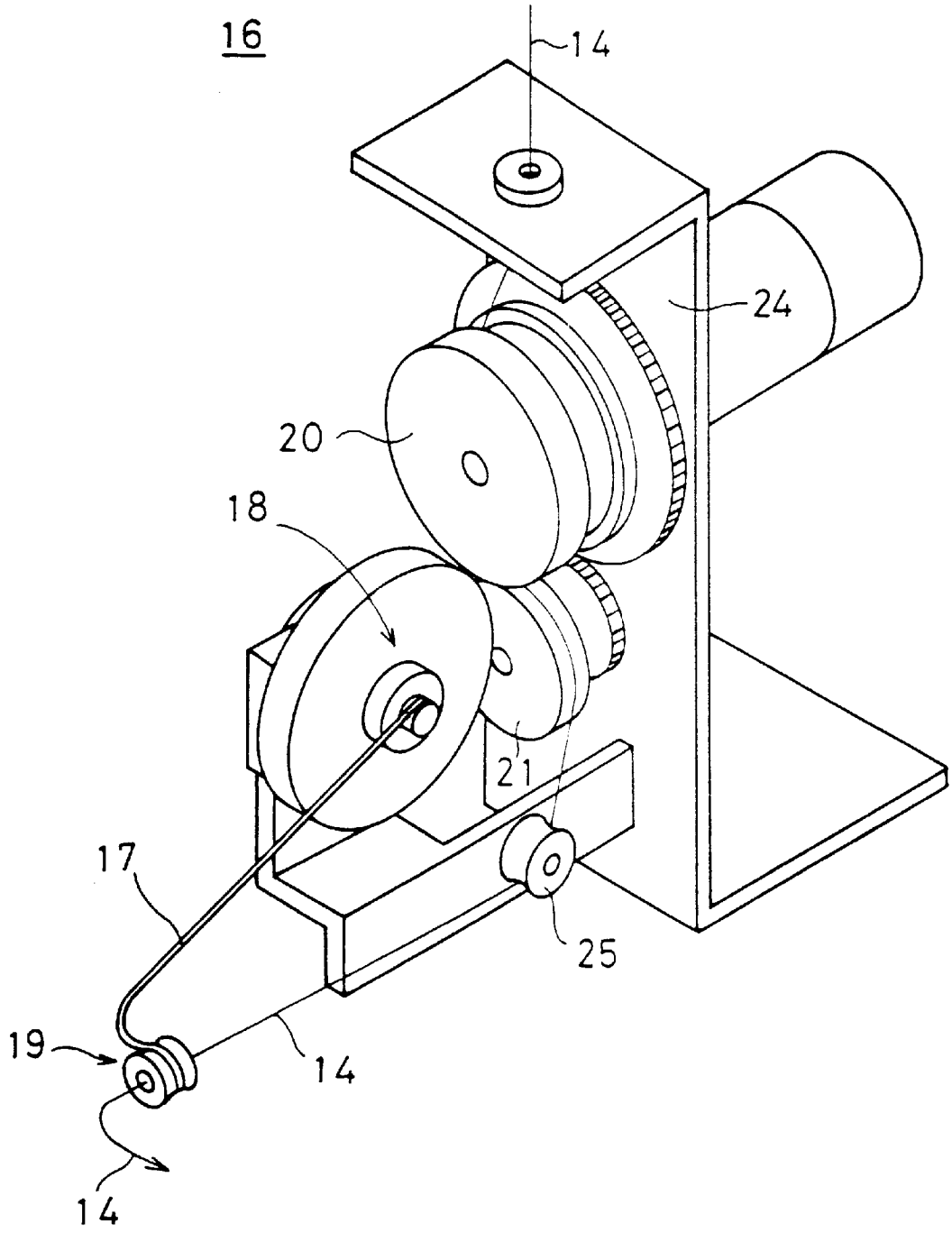
FIG. 4 is a perspective view showing the yarn feeding apparatus in FIG. 1.

The details of the yarn feeding apparatus 16 are shown in FIGS. 2, 3 and 4. FIG. 2 shows a state seen from a front in the same direction as that in FIG. 1, FIG. 3 shows a state seen from a left side, and FIG. 4 shows a state seen obliquely. For convenience of description, directions of a main roller 20 and a driven roller 21 are changed in FIG. 1. With reference to FIGS. 1 to 4, the main roller 20 and the driven roller 21 are provided in order to feed the knitting yarn 14 to the buffer rod 17. The main roller 20 is attached onto a rotary shaft of a servo motor 22 and a rotating force of the servo motor 22 is transmitted to the driven roller 21 through a driven mechanism 23 constituted by a combination of gears. The main roller 20 and the driven roller 21 are provided to interpose the knitting yarn 14 therebetween, and the driven roller 21 is rotated through the driven mechanism 23 at an equal circumferential speed relative to that of the main roller 20. The main roller 20, the driven roller 21, the servo motor 22 and the driven mechanism 23 are attached to the side cover 15 in FIG. 1 through a frame 24. The main roller 20 has a small diameter and the driven roller 21 is provided under the main roller 20. Therefore, one yarn feeding apparatus 16 can be constituted to have a comparatively small width and a plurality of yarn feeding apparatuses 16 can easily be arranged on the side cover 15.

The knitting yarn 14 is fed from above the frame 24 and is led in contact with an outer peripheral surface of the main roller 20 toward a portion in which the driven roller 21 is opposed to the main roller 20. A very small clearance is formed between the outer peripheral surface of the main roller 20 and that of the driven roller 21, and the knitting yarn 14 passes therethrough. Furthermore, the knitting yarn 14 is led to a relay roller 25 and is pulled toward the tip portion 19 of the buffer rod 17 with a direction changed. The base portion 18 of the buffer rod 17 is provided with a spring 26 for urging the tip portion 19 to move away from the surface of the side cover 15. The buffer rod 17 is rocked and displaced by the spring 26 to have a small inclination angle when tension of the knitting yarn 14 is high and to have a great inclination angle when tension of the knitting yarn 14 is low. The inclination angle of the buffer rod 17 is detected by an inclination angle sensor 27 provided on the base portion 18.

Returning to FIG. 1, in the weft knitting machine 11, a needle bed 28 for knitting the fabric 12 is provided rectilinearly, and a knitting operation of the knitting needle of the needle bed 28, along with movement of the yarn feeding port 13, are carried out to knit the fabric 12 while a carriage 29 reciprocates along the needle bed 28. The carriage 29 is provided with a knitting cam for carrying out an advancing and retreating operation of the knitting needle, and the knitting operation is performed by the advancing and retreating operation of the knitting needle. In the automated weft knitting machine 11, the knitting operation for the fabric 12 is controlled by a knitting controller 30, and the fabric 12 is knitted in accordance with knitting data which are previously supplied. In the yarn feeding apparatus 16 according to the embodiment, the servo motor 22 is subjected to PID control such that an inclination angle detected by the inclination angle sensor 27 corresponds to a case in which the tip portion 19 of the buffer rod 17 is placed in an origin position to be a predetermined reference position. When the demand for yarn is suddenly changed, for example, a direction of movement of the carriage 29 is changed, pointing control is carried out with a rapid increase in the demand for the yarn, and control for stoppage of yarn feeding stop is performed without the demand for the yarn and is based on a signal indicative of the position of the carriage which is sent from the knitting controller 30, a signal indicative of the position of the yarn feeding port 13 with respect to the fabric 12, and a signal indicative of the amount of knitting yarn which is calculated from knitting data. During the pointing control, an increase in the demand for the yarn is absorbed by an increase in the inclination angle of the buffer rod 17 before the yarn is actually demanded and is supplied to the yarn feeding port 13.

Figure 5:
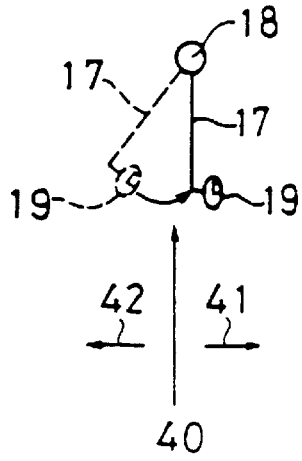
FIG. 5 is a diagram showing a concept of PID control according to the embodiment of the invention.

FIG. 5 shows a concept in which a differential output is switched by the PID control of a yarn feeding controller 31 in FIG. 1. The buffer rod 17 is urged by the spring on the base portion 18. When the inclination angle is increased, an urging force of the spring is reduced. Therefore, the inclination angle has such a relationship as to be increased when a tensile force based on tension of the knitting yarn 14 is reduced. In the case in which the amount of feed of the knitting yarn 14 completely corresponds to the amount of demand for the knitting yarn 14, the inclination angle of the buffer rod 17 can be maintained to be constant and the position of the tip portion 19 can be held to be that of an origin 40 of the buffer rod 17. Actually, the knitting yarn 14 cannot be fed instantaneously corresponding to a fluctuation in the amount of demand for the knitting yarn 14 due to a mechanical inertia of the main roller 20, the driven roller 21 or the servo motor 22. For this reason, rocking and displacement of the buffer rod 17 absorbs a fluctuation in the amount of demand for the knitting yarn 14 to some extent.

When the amount of demand for the knitting yarn 14 is rapidly increased, the inclination angle of the buffer rod 17 is further decreased corresponding to a shortage of the knitting yarn 14 to be fed, and the knitting yarn 14 stored in a path for the knitting yarn 14 which is provided from the relay roller 25 to the yarn feeding port 13 through the tip portion 19 in FIG. 1 is fed to the fabric 12 with a decrease in length of the knitting yarn 14. More specifically, an insufficient side range 41, in which the knitting yarn 14 is insufficient, is set in a direction in which the position of the tip portion 19 is closer to the surface of the side cover 15 than the position of the origin 40. On the other hand, when the knitting yarn 14 is fed from between the main roller 20 and the driven roller 21 irrespective of a small demand for the knitting yarn 14, the inclination angle is increased such that the tip portion 19 of the buffer rod 17 becomes more distant from the side cover 15 than the position of the origin 40, and extra knitting yarn 14 is stored. More specifically, when the position of the tip porton 19 is more distant from the side cover 15 than the position of the origin 40, the knitting yarn 14 is set into a remainder side range 42 in which a remainder is generated.

During PID control of the servo motor 22, the amount of feed of the knitting yarn 14 is rapidly controlled corresponding to a fluctuation in the inclination angle of the buffer rod 17. Therefore, control is carried out by a differential output obtained by differentiating a detection signal sent from the inclination angle sensor 27. The control based on the differential output responds to a slight fluctuation in the inclination angle. As a result of the control, therefore, there is a possibility that the inclination angle of the buffer rod 17 might be sensitively changed to generate an oscillation. For this reason, when the tip portion 19 of the buffer rod 17 enters the range in which the knitting yarn 14 is insufficient, apart from the origin position, the differential output is set to 0 to stabilize the control. More specifically, by setting the rod origin position to be a reference, control is carried out in consideration of the differential output within the range in which the knitting yarn 14 remains, and in consideration of no differential output within a range in which the knitting yarn 14 is insufficient.

Figure 6:
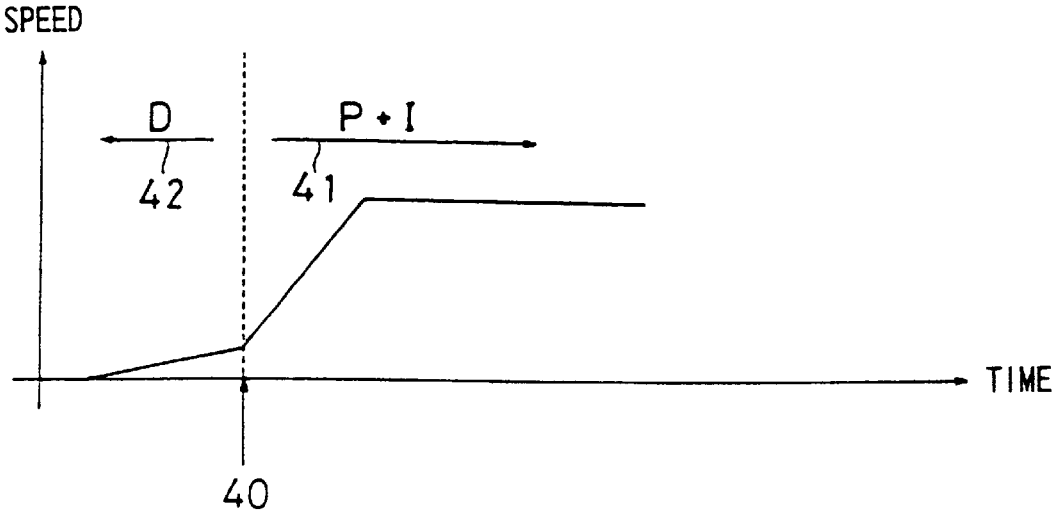
FIG. 6 is a graph showing a concept of PID control according to another embodiment of the invention.

FIG. 6 shows a concept of the PID control for speed of the servo motor 22 according to another embodiment of the invention. In the same manner as in the embodiment shown in FIG. 5, the origin 40 is set with respect to the position of the tip portion 19 of the buffer rod 17, and a component for controlling rotational speed of the servo motor 22 is switched through the PID control within the remainder side range 42 in which the knitting yarn 14 remains and the insufficient range 41 in which the knitting yarn 14 is insufficient, by using the origin 40 as a reference. In the remainder side range 42 of the knitting yarn 14, the control is carried out by using only a differential component D. After the tip side 19 of the buffer rod 17 passes through the origin 40 and once enters the insufficient side range 41, control using a proportion component P and an integral component I is started. When the remainder side range 42 is continuously switched into the insufficient side range 41, the differential component D is converted into the integral component I during a time of a passage through the origin 40. Therefore, the proportion component P is 0 and the output can be switched without a difference in the speed.

Figure 7:
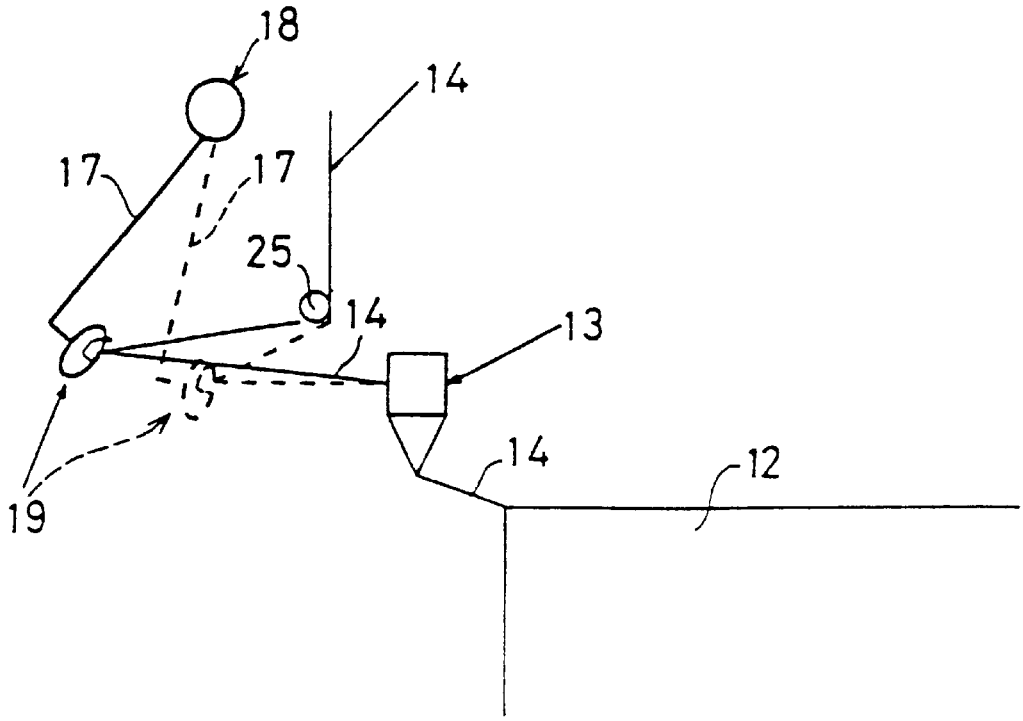
FIG. 7 is a view showing a concept in which a knitting yarn is excessively stored in a buffer rod before the demand for the knitting yarn is suddenly increased according to each embodiment of the invention.

FIG. 7 shows a state obtained immediately before the yarn feeding port 13, placed close to an end on the yarn feeding apparatus side as shown in FIG. 1, is moved in such a direction as to be separated from the yarn feeding apparatus 16, thereby knitting the fabric 12. When knitting is started in this state, the amount of demand for the knitting yarn 14 is rapidly increased. Consequently, one course is knitted over the fabric 12 and the knitting yarn 14 is slowly fed such that the tip portion 19 of the buffer rod 17 comes to a preset position within the remainder side range apart from the origin while the yarn feeding port 13 leaves the end of the course knitted in the fabric 12 immediately before, and a knitting operation for a next course is started. When the yarn feeding port 13 leaves the end of the fabric 12, and the course knitted immediately before is completed in a position shown by a broken line, the knitting yarn 14 can be excessively stored with an increase in the inclination angle shown by a solid line before knitting for the next course is started. In the case in which the knitting yarn 14 is thus stored up to the remainder side range, the servo motor 22 increases the amount of feed of the knitting yarn 14 by the control using the differential component of a change in inclination angle before the tip portion 19 of the buffer rod 17 is returned to the origin even if the demand for the knitting yarn 14 is rapidly increased so that the knitting yarn 14 is fed from the main roller 20 and the driven roller 21 with an instant delay. Therefore, it is possible to feed the knitting yarn 14 while suppressing fluctuation in a yarn tension against a rapid increase in the amount of demand for the knitting yarn 14.

Figure 8:
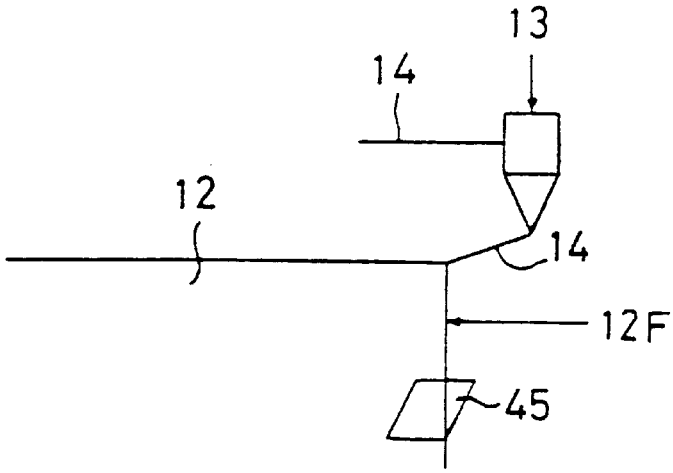
FIG. 8 is a view showing a concept in which control for stopping feed is carried out when the demand for the knitting yarn is eliminated according to each embodiment of the invention.

FIG. 8 shows a concept of control to be carried out when the yarn feeding port 13 leaves the fabric 12 at a knitting end 12F positioned apart from the side cover 15 provided with the yarn feeding apparatus 16 in the weft knitting machine 11 shown in FIG. 1. The carriage 29 to be moved together with the yarn feeding port 13 includes a knitting cam 45 for causing the knitting needle to carry out a knitting operation. When a position of the knitting cam 45 leaves the knitting end 12F, an output for the yarn feeding operation of the main roller 20 and the driven roller 21 is set to be zero. Consequently, the servo motor 22 can be suddenly stopped so as not to excessively supply the knitting yarn 14. When the yarn feeding port 13 is moved toward the fabric side to start knitting for the next course, the demand for the knitting yarn 14 is rapidly increased in the same manner as in FIG. 7. Therefore, the knitting yarn 14 is stored in the buffer rod 17.

Figure 9A:
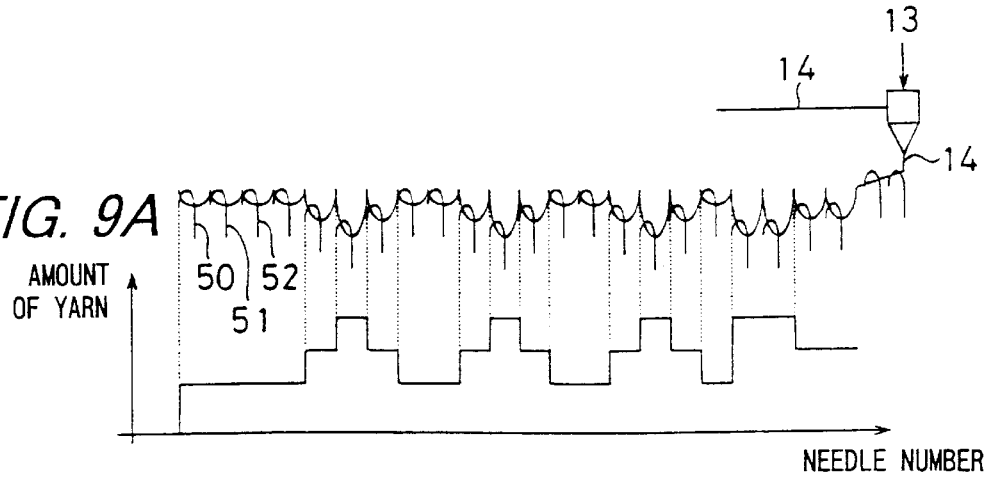
FIGS. 9A to 9C are graphs showing a concept of control for feeding the knitting yarn corresponding to the amount of consumption of the yarn for each knitting needle to knit a fabric according to each embodiment of the invention.
Figure 9B:
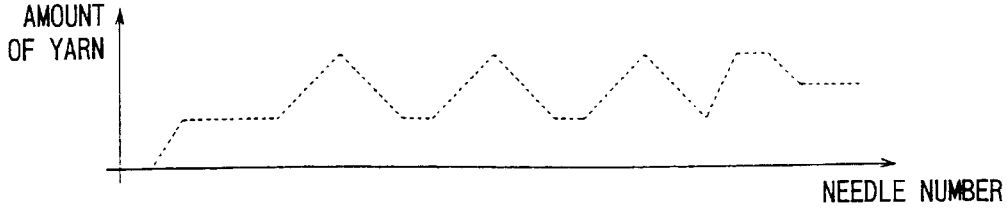
Figure 9C:
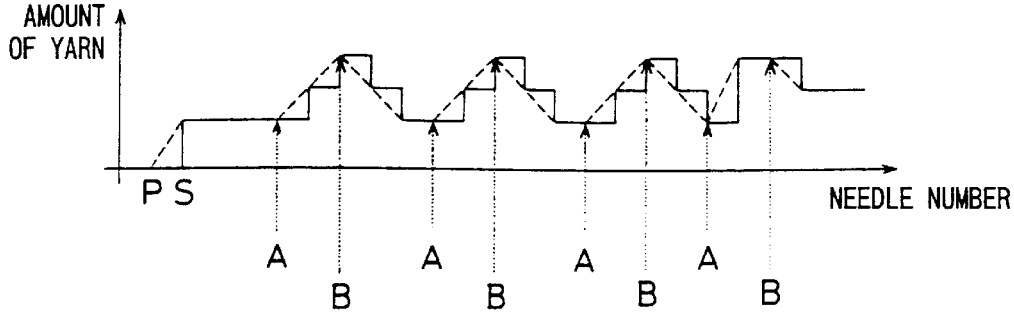

FIGS. 9A to 9C show a concept for predicting an amount of demand for yarn based on knitting data for each of knitting needles 50, 51, 52, . . . , and feeding knitting yarn 14 having a length corresponding to the amount of demand. Stitches of the knitting needles 50, 51, 52, . . . to be used are preivously set to the knitting controller 30 of the weft knitting machine 11 for each course to form the fabric 12 in order of a needle number corresponding to an array in the needle bed 28. A length of the knitting yarn 14 drawn into the stitches of the knitting needles 50, 51, 52, . . . form a stitch loop. Various patterns can be knitted with a variation in a length of the stitch loop. The amount of feed of the yarn is set as shown by a dotted line of FIG. 9B corresponding to an amount of consumption of the yarn for each needle shown in a solid line of FIG. 9A. In FIG. 9C, the amount of consumption of the yarn in FIG. 9A is shown by a solid line and the amount of feed of the yarn in FIG. 9B is shown by a broken line. Corresponding to a change in amount of feed of the yarn shown by the broken line, the knitting yarn 14 is started to be fed on this side P of a knitting end S, and an acceleration start A and a deceleration start B of the servo motor 22 are controlled by a feed-forward method. Thus, acceleration/deceleration is carried out on a side of a position in which the amount of consumption of the yarn is changed, and fluctuation in yarn tension can be reduced.

Figure 10A:
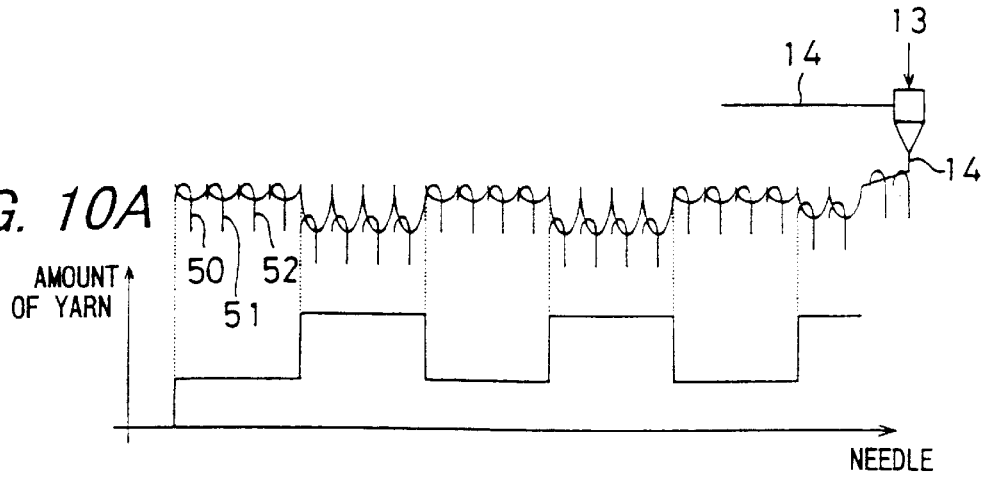
FIGS. 10A to 10C are graphs showing a concept for feeding the knitting yarn corresponding to the amount of demand for the yarn for plural knitting needles to knit the fabric according to each embodiment of the invention.
Figure 10B:
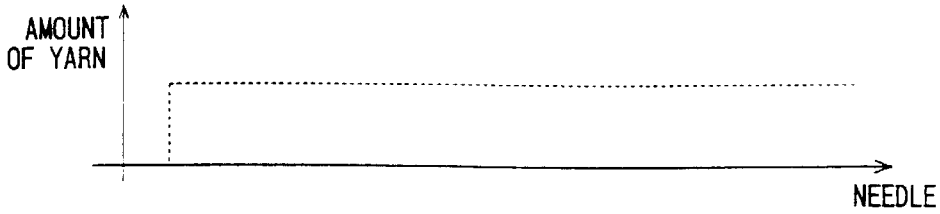
Figure 10C:
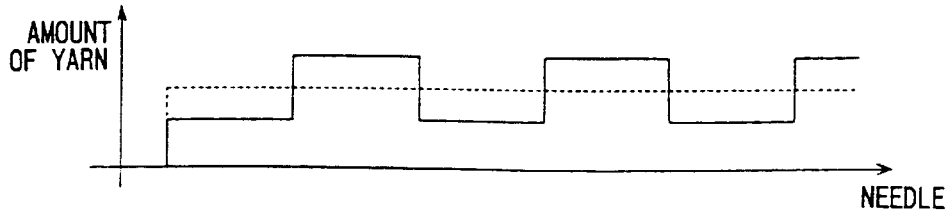

FIGS. 10A to 10C show a concept of control for averagely feeding knitting yarn 14 to every knitting needle 50, 51, 52, . . . When an amount of consumption of yarn is changed by the knitting needles 50, 51, 52, . . . as shown by a solid line of FIG. 10A, the yarn is fed corresponding to the average of an entire amount as shown by a dotted line of FIG. 10B. FIG. 10C shows a superposition of FIG. 10A and FIG. 10B. As shown in FIG. 10C, demand for the yarn is increased or decreased according to a mean value of the amount of feed as shown in FIG. 10C so that a tension is also changed. In a knitting operation to be carried out with a regular change in amount of consumption of the yarn, such as jacquard knitting, however, a more excellent fabric 12 can be obtained by the control for feeding the yarn on a unit of knitting needles. Accordingly, it is preferable that the concept for feeding the yarn as shown in FIGS. 9A to 9C, or FIGS. 10A to 10C, should be changed corresponding to a fabric to be knitted.

Figure 11A:
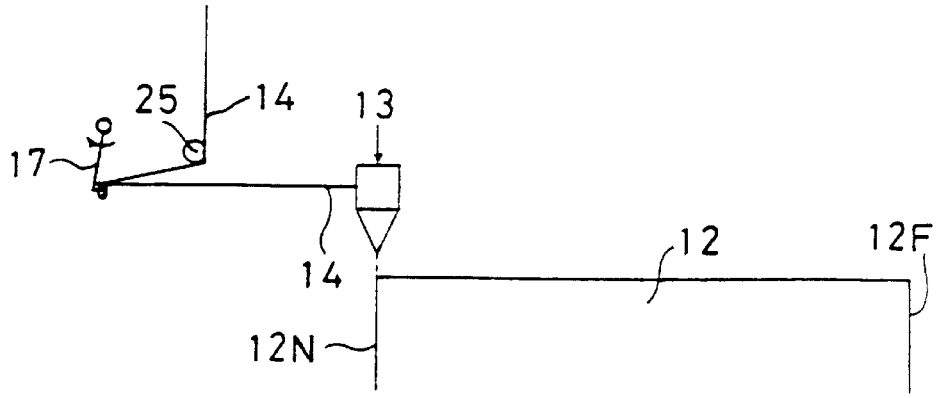
FIGS. 11A to 11C are views showing a concept for accurately calculating the length of the knitting yarn fed to the fabric when a yarn feeding port moves away from the yarn feeding apparatus according to each embodiment of the invention.
Figure 11B:
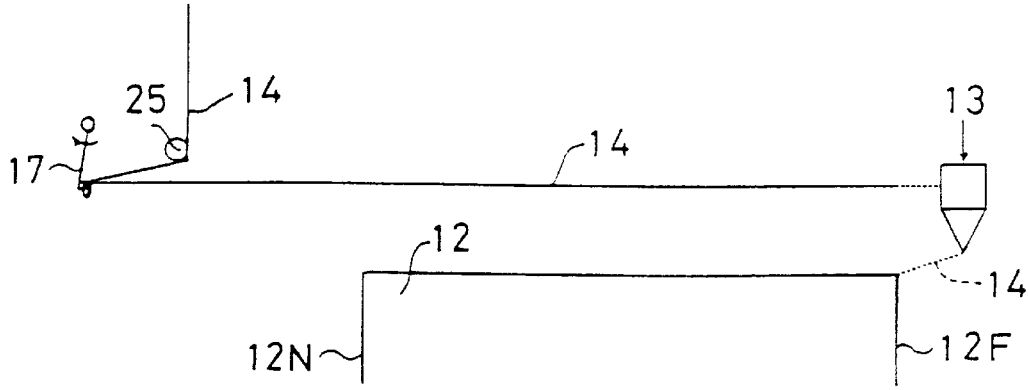
Figure 11C:
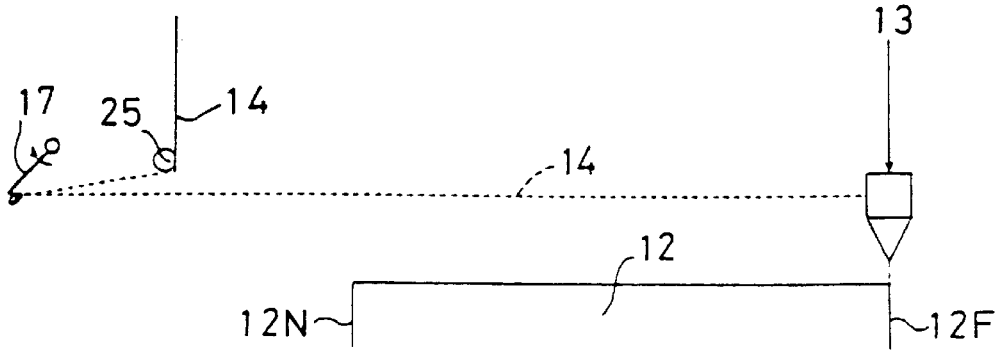

FIGS. 11A to 11C show a concept for accurately measuring a length of knitting yarn 14 to be fed to fabric 12 while the yarn feeding port 13 is moved from a side close to the yarn feeding apparatus 16 toward a side distant therefrom. As shown in FIG. 11A, data are started to be fetched when the yarn feeding port 13 comes to a knitting end 12N of the fabric 12, which is closer to the yarn feeding apparatus 16 as illustrated on the left side. As shown in FIG. 11B, when the yarn feeding port 13 is moved to the right and passes through the knitting end 12F of the fabric 12, which is distant from the yarn feeding apparatus 16, and movement to right is thus completed, the length of the knitting yarn 14 within a range shown by a dotted line is unknown. As shown in FIG. 11C, when the yarn feeding port 13 is returned to knitting end 12F of the fabric 12 during the knitting operation for a next course, the knitting yarn 14 portion which is shown by the dotted line of FIG. 11B, is unknown and is returned to the buffer rod 17 and is absorbed therein. The length of the knitting yarn 14 stored in the buffer rod 17 can be calculated from the inclination angle of the buffer rod 17. Moreover, the amount of the knitting yarn 14 fed from the main roller 20 can be calculated based on a signal sent from an encoder provided in the servo motor 22. A knitting width of the fabric 12 can easily be obtained from mechanical specifications of the weft knitting machine 11 and knitting data. Therefore, the length of the knitting yarn 14 used during the knitting operation for one course of the fabric 12 can accurately be calculated as a difference between a state in a data fetch starting position, shown in FIG. 11A, and a state in a data fetch ending position, shown in FIG. 11C. More specifically, the amount of the yarn can accurately be obtained from a difference between the inclination angle of the buffer rod 17 in the data fetch ending position and the inclination angle of the buffer rod in the data fetch starting position, an encoder value, and the knitting width of the fabric 12.

Figure 12A:
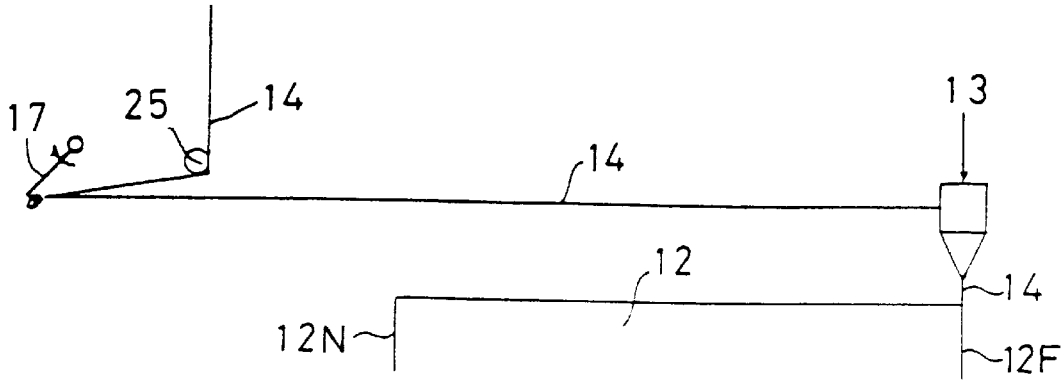
FIGS. 12A and 12B are views showing a concept for accurately calculating the length of the knitting yarn fed to the fabric when the yarn feeding port approaches the yarn feeding apparatus according to each embodiment of the invention.
Figure 12B:
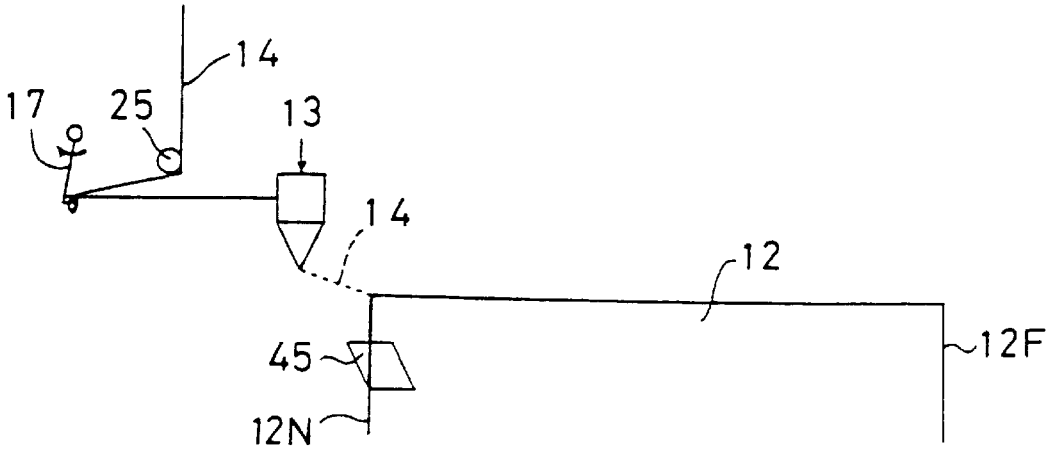

FIGS. 12A and 12B show a concept for fetching, as data, a length of the knitting yarn 14 to be fed while the yarn feeding port 13 is moved from the knitting end 12F, distant from the yarn feeding apparatus 16, to the knitting end 12N close thereto. As shown in FIG. 12A, data fetch is started at a position in which the yarn feeding port 13 is at the distant knitting end 12F of the fabric 12. As shown in FIG. 12B, the data fetch is completed when the position of the knitting cam 45 of the carriage 29 comes to knitting end 12N of the fabric 12. It is not necessary to consider the length of the knitting yarn 14, between the yarn feeding port 13 and the knitting end 12N of the fabric 12 when the yarn feeding port 13 further approaches the yarn feeding apparatus side, shown by a broken line.

The amount of the yarn moved to the right as shown in FIGS. 11A to 11C can be calculated as follows:

the amount of the yarn moved to the right=the amount of the yarn calculated from the encoder−knitting width+the amount of the yarn with a change in the rod . . . (1)

Moreover, the amount of the yarn moved to the left as shown in FIGS. 12A and 12B can be calculated as follows:

the amount of the yarn moved to the left=the amount of the yarn calculated from the encoder+knitting width+the amount of the yarn with a change in the rod . . . (2)

Figure 24:
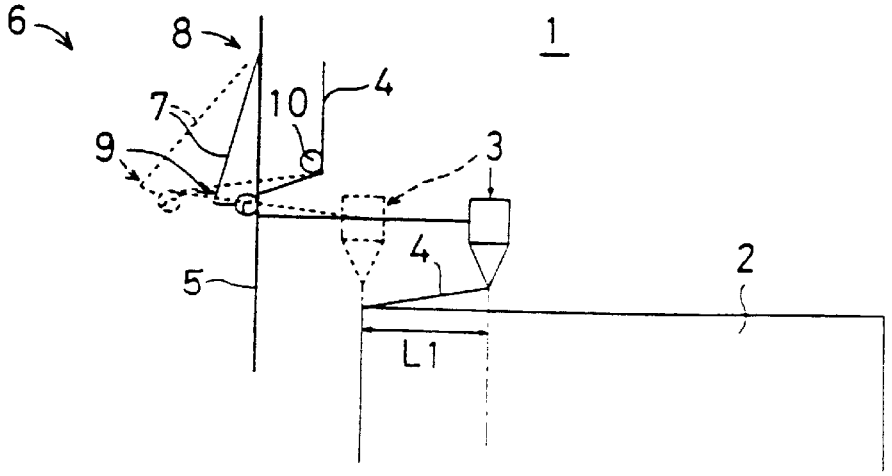
FIG. 24 PRIOR ART
FIG. 24 is a view showing the reason why length of knitting yarn cannot be accurately measured within a constant range from an end at which a fabric is close to a conventional yarn feeding apparatus.
Figure 25:
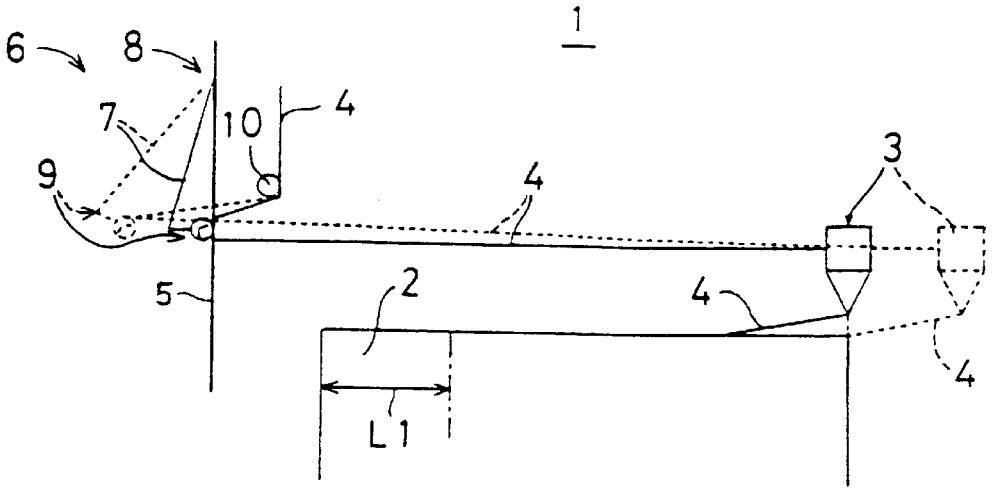
FIG. 25 PRIOR ART
FIG. 25 is a view showing that it is impossible to accurately measure length of knitting yarn to be fed through a yarn feeding port in the vicinity of an end of the fabric which is distant from the conventional yarn feeding apparatus.

In the yarn feeding apparatus 16 according to the embodiment, the main roller 20 is rotated by the servo motor 22 and the knitting yarn 14 is actively fed. Therefore, as in the case in which the amount is to be passively measured by the length measuring roller 10 shown in FIGS. 24 and 25, therefore, an error made by the influence of inertia can be reduced and a precise amount of feed of the knitting yarn 14 can be calculated to accurately supply the knitting yarn 14 required for knitting a stitch loop. Thus, it is possible to obtain fabric 12 of good quality.

Figure 13:
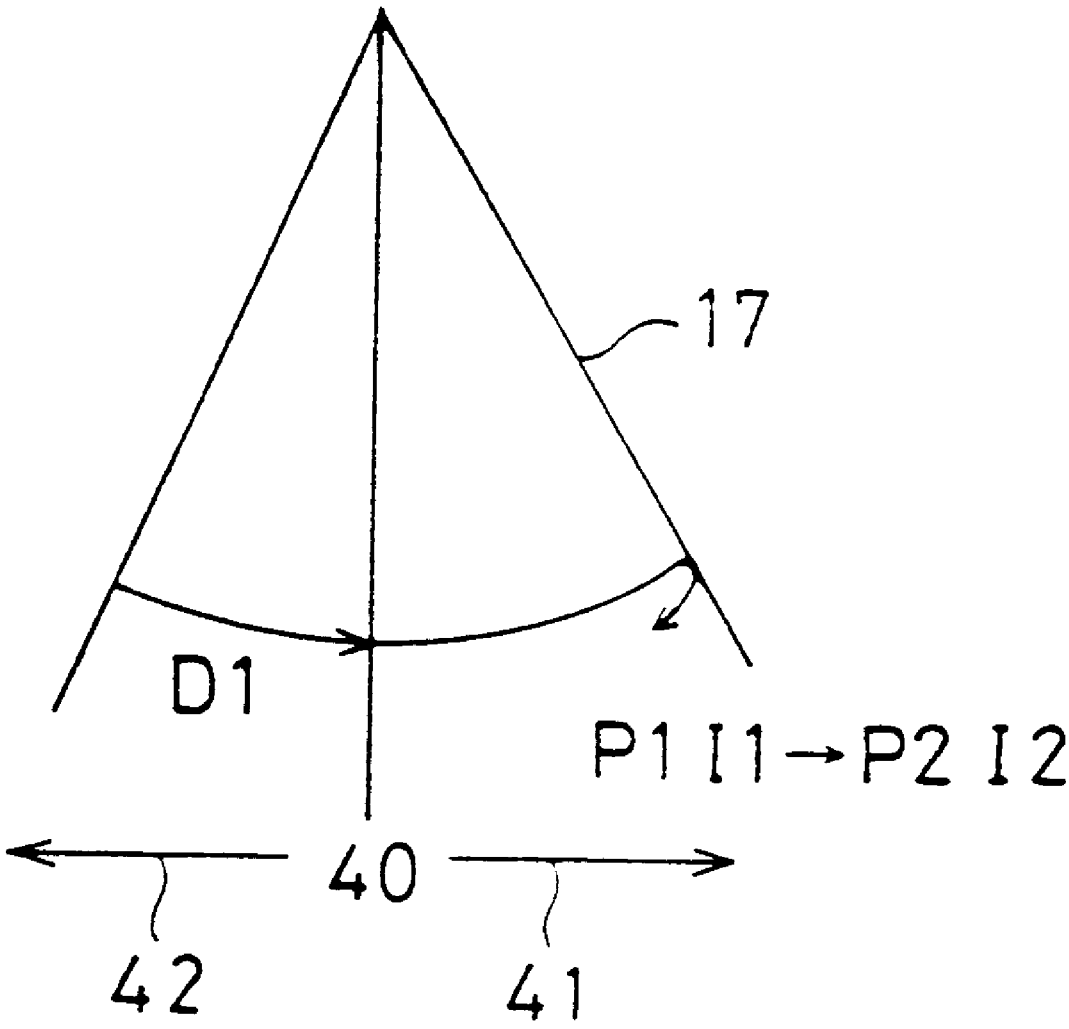
FIG. 13 is a view showing a state in which PID control is switched into D control and PI control when the buffer rod passes through an origin and control is changed from a high gain to a low gain after an oscillation of the buffer rod is maximized according to a further embodiment of the invention.

FIG. 13 shows PID control switching of the yarn feeding controller 31 according to another embodiment of the invention. In this embodiment, control is carried out in consideration of a differential output with the tip portion 19 of the buffer rod 17 set in the remainder side range 42 apart from the position of the origin 40, and the control is carried out in consideration of no differential output within the insufficient side range 41 in the same manner as in FIG. 5. In the insufficient side range 41, a gain is switched when the buffer rod 17 reaches a position in which it is oscillated most greatly and is then returned in a constant amount toward the origin 40. More specifically, the gain of the PI control within the insufficient side range 41 is switched from P1 and I1 to P2 and I2 to set P1>P2 and I1>I2 as shown in the following Table 1.

TABLE 1

| | Origin | Switching | |
|---|---|---|---|
| P | 0 | P1 | P2 |
| I | 0 | I1 | I2 |
| D | D1 | 0 | 0 |

In the switching of the gain of the PI control, it is also possible to switch only the gain of a P component and to leave an I component as it is. More specifically, it is also possible to set P1>P2 and I1≧I2.

The gain is switched when the tip portion 19 of the buffer rod 17 is oscillated most greatly and is then returned in a constant amount. The reason is that the buffer rod 17 should be reliably oscillated most greatly. Whether maximum oscillation is carried out is known after the buffer rod 17 is started to be returned. The constant amount is set to approximately 5 degrees to be an angle at which the buffer rod 17 is returned, for example. This value can be changed because an optimum value is varied depending on a method of knitting a fabric, a type of a yarn and a knitting speed.

As described above, in each embodiment according to the invention, the knitting yarn 14 is stored in the buffer rod 17 before a knitting operation for each course is started, and PID control of the servo motor 22 for drawing the knitting yarn 14 is carried out by only the D component within a knitting start range. When the knitting start range is completed and the tip side 19 of the buffer rod 17 passes through the origin, a knitting range to be controlled by only the PI component is subsequently provided. The knitting range is controlled by the PI component irrespective of the inclination angle of the buffer rod 17. Referring to the gain switching, similarly, the knitting start range is controlled with a high gain, and the high gain is switched to a low gain when the buffer rod 17 is oscillated most greatly and is then returned in a constant amount. Thus, the knitting range is controlled with the low gain.

Figure 14:
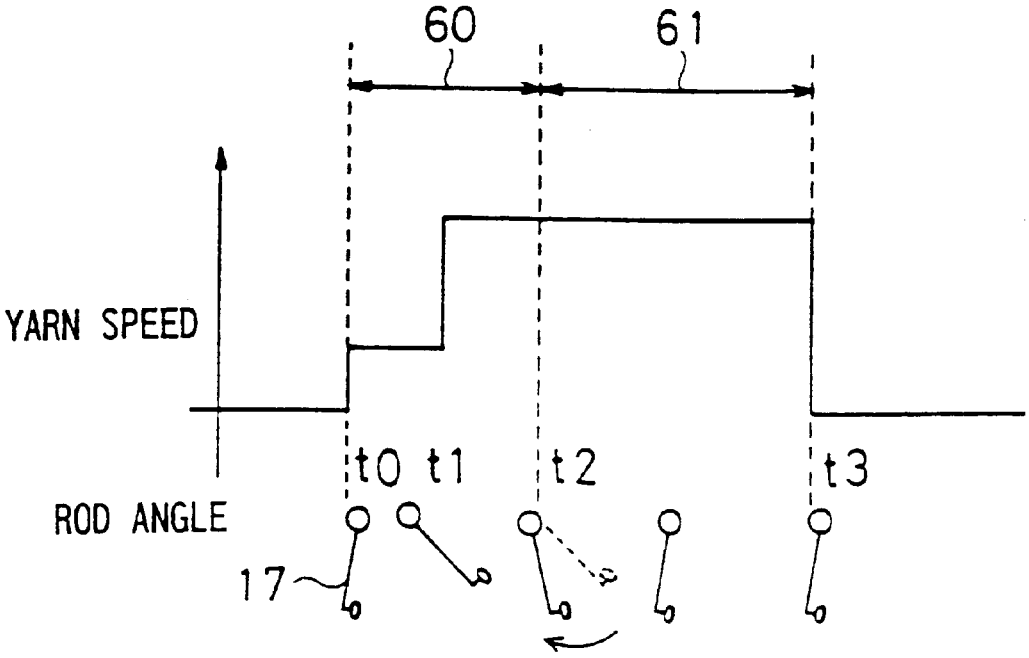
FIG. 14 is a graph and view showing a temporal change in speed of a yarn and an angle of the buffer rod during knitting.
Figure 15:
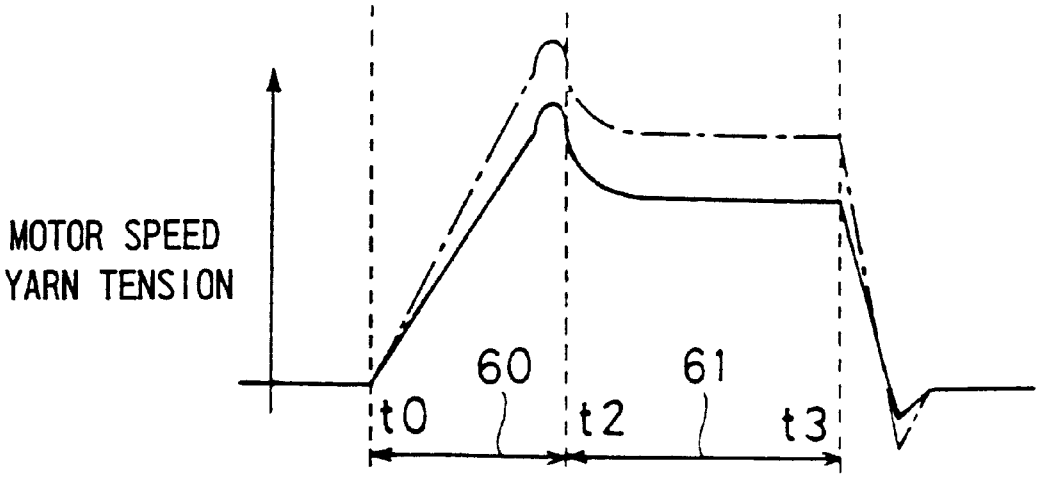
FIG. 15 is a graph showing a change in rotational speed of a servo motor and tension of a yarn in a case in which the gain is switched by the PI control.
Figure 16:
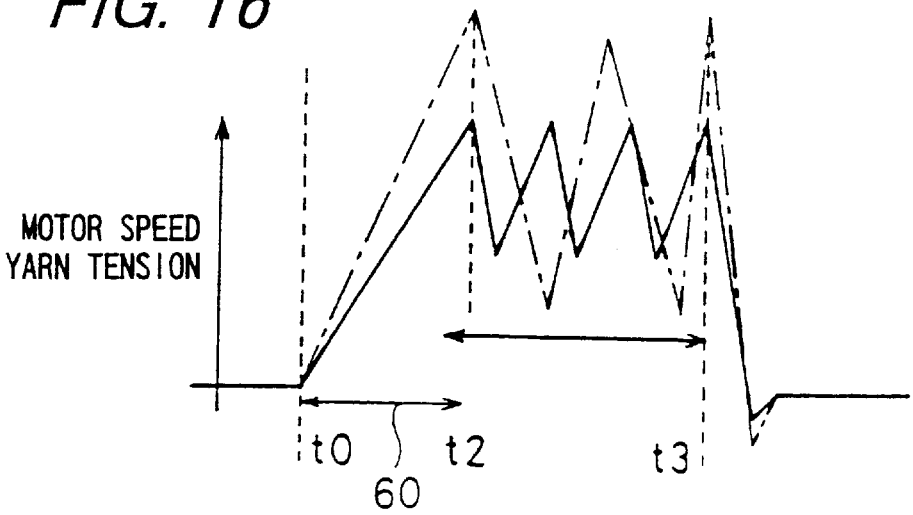
FIG. 16 is a graph showing a change in rotational speed of the servo motor and tension of the yarn in a case in which the gain is not switched by the PI control but a high gain is maintained.
Figure 17:
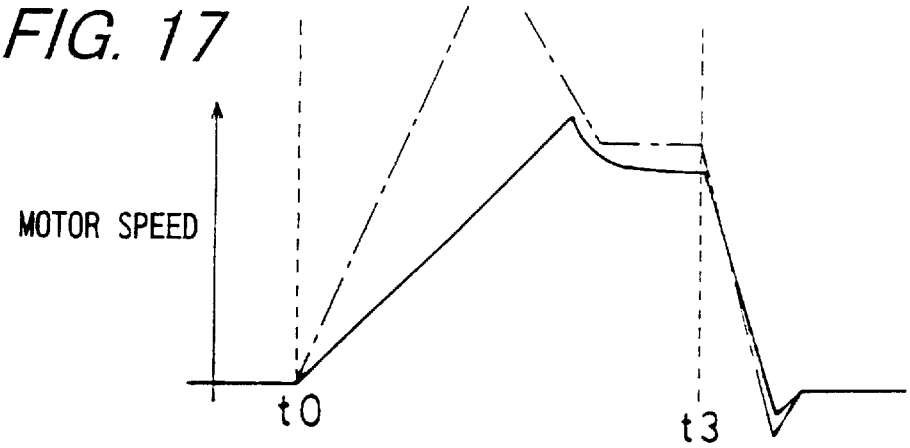
FIG. 17 is a graph showing a change in rotational speed of the servo motor and tension of the yarn in a case in which the gain is not switched by the PI control but a low gain is maintained.

FIGS. 14 to 17 show the reason why the gain switching is carried out as shown in FIG. 13. FIG. 14 shows a schematic temporal change in yarn speed at which the servo motor 22 supplies the knitting yarn 14 and an inclination angle of the buffer rod 17. FIG. 15 shows the case in which the gain is switched, FIG. 16 shows the case in which the switching is not carried out to maintain a high gain, and FIG. 17 shows the case in which the switching is not carried out to maintain a low gain, wherein a rotational speed of the servo motor 22 and a yarn tension are shown by a solid line and a one-dotted chain line, respectively.

As shown in FIG. 14, at a time t0 that a knitting start range 60 begins, the buffer rod 17 is started to be displaced from the origin to the insufficient side range and the stored knitting yarn 14 is supplied. At a time t1, when the amount of the knitting yarn 14 to be fed by rotation of the servo motor 22 is larger than that of the knitting yarn 14 to be used for the knitting operation, the buffer rod 17 is started to be returned from a maximum oscillation angle toward the origin. When the buffer rod 17 is returned in a constant amount from the maximum oscillation angle at a time t2, the gain is switched to be reduced. Subsequently, the fabric 12 for one course is completely knitted at a time t3. FIG. 15 shows the speed of the servo motor 22 by the solid line. As shown by a broken line of FIG. 15, the yarn tension shown by the one-dotted chain line within the knitting start range 60 can be suppressed and oscillation within a knitting range 61 can be prevented.

In FIG. 16 showing motor speed by the solid line and yarn tension by the one-dotted chain line, in the case in which the high gain is maintained from a knitting start within the knitting start range 60 to a knitting end within the knitting range 61, an overshoot is generated in the control within the knitting range 61 so that oscillation is caused, for example. In FIG. 17 showing the motor speed by the solid line and the yarn tension by the one-dotted chain line, moreover, in the case in which the low gain is maintained, it takes time to obtain a necessary speed and a countermeasure cannot be taken against a sudden demand for the knitting yarn 14 at the start of a knitting operation. Therefore, yarn tension is increased.

Figure 18:
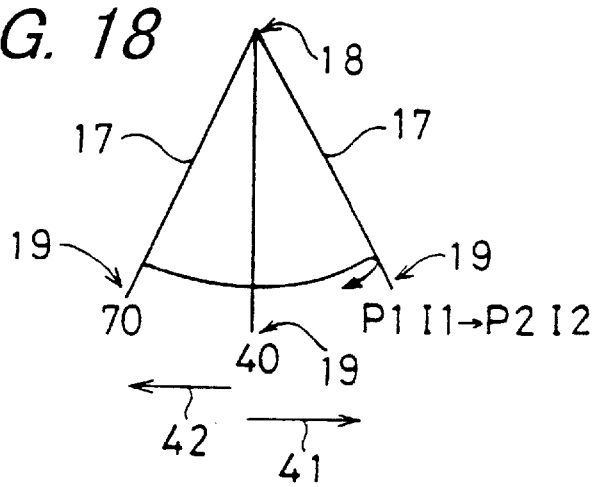
FIG. 18 is a view showing a state in which a position for the start of knitting is set to be a temporary origin, the origin is switched into a substantial origin when the PI control is started and the buffer rod passes through the substantial origin, and the control is changed from a high gain to a low gain after the oscillation of the buffer rod is maximized according to a further embodiment of the invention.

FIG. 18 shows PID control switching of the yarn feeding controller 31 according to a further embodiment of the invention. In this embodiment, control is carried out without consideration of a differential output even when the tip portion 19 of the buffer rod 17 is within the remainder side range 42 apart from the position of the origin 40, and an operation based on a concept for switching a gain is performed when the buffer rod 17 reaches its greatest oscillation position and is then returned in a constant amount toward the origin 40 within the insufficient side range 41. A position in which the tip portion 19 of the buffer rod 17 is present at the start of the knitting operation is set to be a temporary origin 70, which is a control reference. When the tip portion 19 is moved toward the insufficient range side and passes through substantial origin 40, the control reference is restored from the temporary origin 70 to the substantial origin 40. More specifically, as shown in the following Table 2, there is carried out PI control in which a differential component is zero at the knitting start within the insufficient side range 41 in respect of control even if the remainder side range 42 is substantially set. Within the insufficient side range 41 in place of the substantial origin 40, the gain is switched from P1 and I1 to P2 and I2, and P1>P2 and I1>I2 are set in a position in which the tip portion 19 reaches a maximum oscillation and is then returned in a constant amount in the same manner as in FIG. 13.

TABLE 2

| | Temporary origin | Origin | Switching |
|---|---|---|---|
| P | P1 | P1 | P2 |
| I | I1 | I1 | I2 |
| D | 0 | 0 | 0 |

In the same manner as in the embodiment shown in FIG. 13, it is also possible to set P1>P2 and I1 I2.

Figure 19:
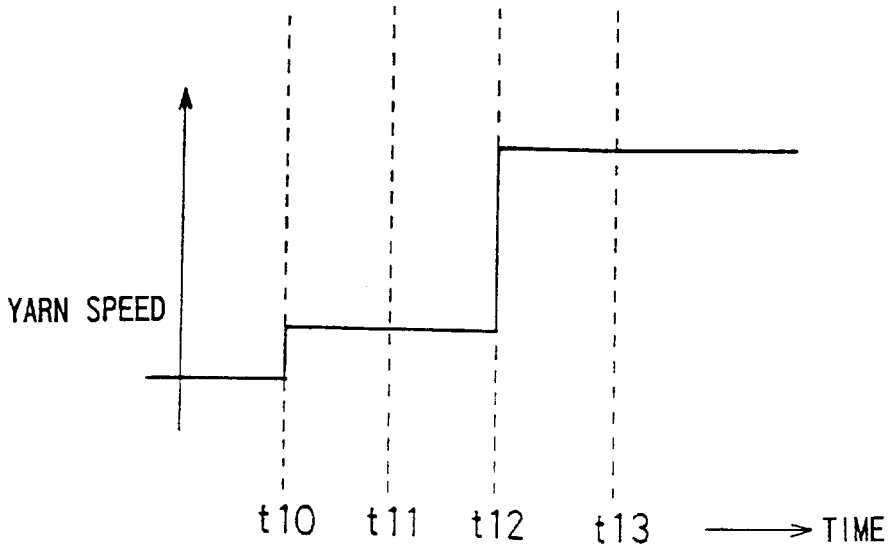
FIG. 19 is a graph showing a temporal change in speed of a yarn at the start of knitting.
Figure 20A:
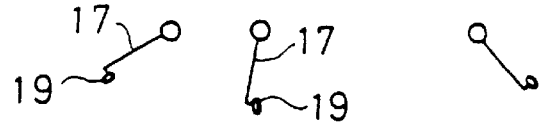
FIGS. 20A and 20B are a view showing a schematic inclination state of the buffer rod in a case in which the D control is carried out from the start of the knitting to the passage through the origin and the PI control is started at the origin, and a graph showing a change in rotational speed of the servo motor, respectively.
Figure 20B:
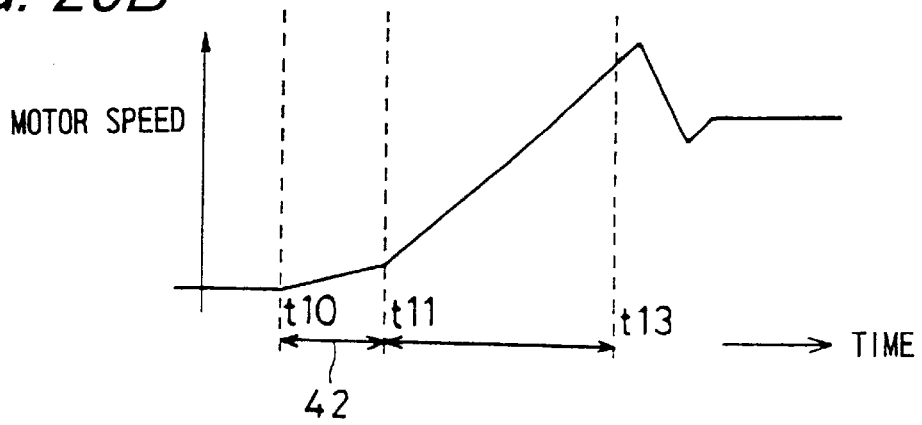
Figure 21A:
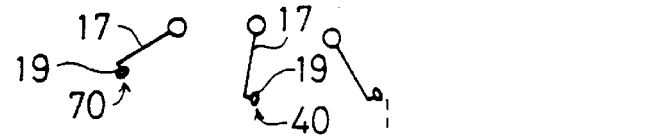
FIGS. 21A and 21B are a view showing the schematic inclination state of the buffer rod in a case in which the PI control is carried out by setting a position for the start of the knitting to be a temporary origin and the origin is switched to a substantial origin, and a graph showing a change in rotational speed of the servo motor, respectively.
Figure 21B:
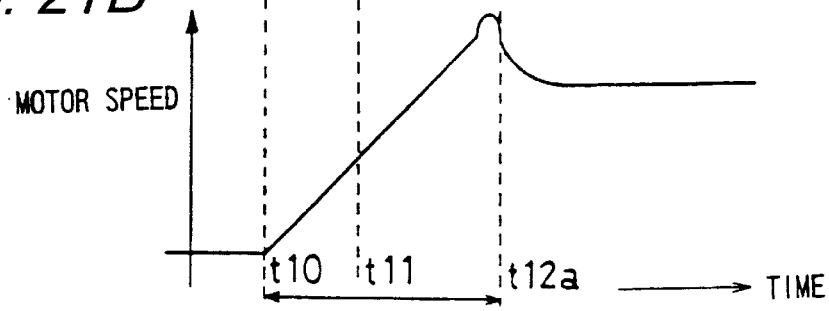

FIGS. 19 to 21B show the reason why it is preferable that a position of a knitting start for one course should beset to be the temporary origin 70, and an origin to be a control reference should be switched from the temporary origin 70 to the substantial origin 40 when the position of the tip portion 19 of the buffer rod 17 passes through the substantial origin 40 as shown in FIG. 18. FIG. 19 shows a change in yarn speed at which the knitting yarn 14 is to be fed from the servo motor 22 when knitting the fabric 12 requires a large amount of knitting yarn 14, such as a full rib stitch, in the weft knitting machine 11 shown in FIG. 1. FIG. 20A schematically shows movement of the buffer rod 17 in the case in which switching is carried out to perform D control based on a differential component within the remainder side range 42 apart from the substantial origin 40 after the knitting start, and to perform PI control based on proportion and integral components at the origin 40. And FIG. 20B schematically shows a change in rotational speed of the servo motor 22. FIG. 21A schematically shows movement of the buffer rod 17 in the case in which the PI control is carried out after the knitting start through origin switching in which the position of the knitting start is set to be the temporary origin 70, and FIG. 21B schematically shows a change in rotational speed of the servo motor 22.

As shown in FIG. 19, when the knitting operation is started at a time t10, yarn speed is maintained to be comparatively low until an origin passage state in which the position of the tip portion 19 of the buffer rod 17 passes through the position of the substantial origin 40 at a time t11, and the tip portion 19 is further oscillated to the insufficient side range and continues to have a comparatively low speed until a time t12. From the time t10 to the time t12, the inclination angle of the buffer rod 17 is changed to reel the stored knitting yarn 14. Therefore, the speed of the yarn to be fed by the rotation of the servo motor 22 is comparatively low. The rotational speed of the servo motor 22 is increased and the yarn speed is increased at the time t12 and the fabric 12 is continuously knitted through a time t13.

As shown in FIGS. 20A and 20B, in the case in which the origin switching is not carried out, only D control is performed based on the differential component from the time t10 that the knitting operation is started to the time t11 that the tip portion 19 of the buffer rod 17 passes through the origin. At the origin 40, the switching is carried out from the D control to the PI control to be performed after the time t11. From the time t10 to the time t11, the control is carried out based only on the differential component. In knitting for a full rib stitch at a high yarn speed, an increase of the rotational speed of the servo motor 22 is too late so that the buffer rod 17 is oscillated to a possible limitation within the insufficient side range at the time t13. Even if the buffer rod 17 is oscillated to this limitation, the amount of feed of the knitting yarn 14 is insufficient and a tension higher than the tension of the spring for urging the buffer rod 17 is applied to the knitting yarn 14.

As shown in FIGS. 21A and 21B, in the case in which the origin switching is to be carried out, the PI control is started by setting the position of the tip portion 19 of the buffer rod 17 to be the temporary origin 70 during the knitting start. Therefore, the PI control having a high gain is carried out within the insufficient side range for a period from the time t10 to the time t11 in which the tip portion 19 of the buffer rod 17 is moved from the temporary origin 70 to the substantial origin 40. Consequently, the servo motor 22 is rotated quickly before the buffer rod 17 is oscillated to the limitation, and the buffer rod 17 is returned in a constant amount from the maximum oscillation at a time t12*a*. Since a position in which the buffer rod 17 is oscillated to the maximum does not reach the limitation, tension applied to the knitting yarn 14 is reduced to such a range as to be balanced with the spring for urging the buffer rod 17. After the time t12*a*, the PI control having a low gain is carried out.

Figure 22A:
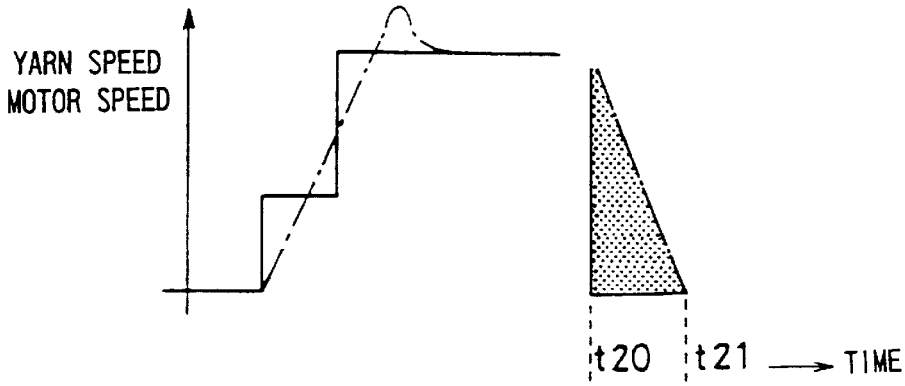
FIGS. 22A and 22B are a graph showing the speed of the yarn and the rotational speed of the servo motor in a case in which the servo motor is started to be stopped at a knitting end, and a view showing a change in inclination angle of the buffer rod, respectively.
Figure 22B:
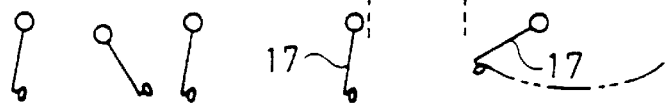
Figure 23A:
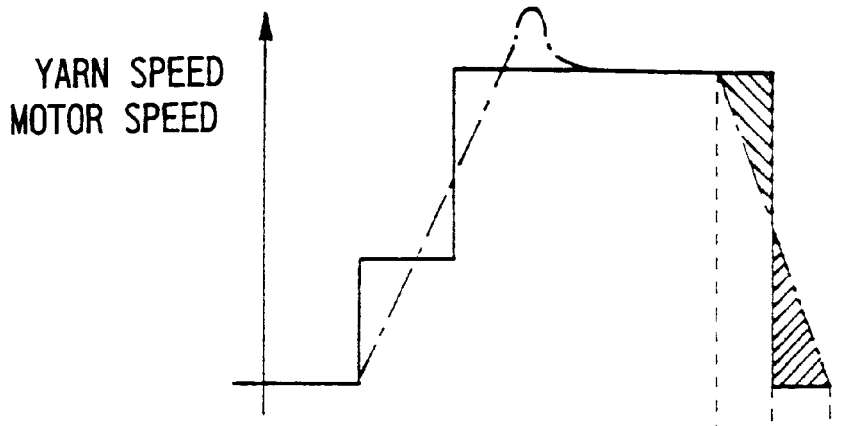
FIGS. 23A and 23B are a graph showing the speed of the yarn and the rotational speed of the servo motor in a case in which the servo motor is started to be stopped prior to the knitting end, and a view showing a change in inclination angle of the buffer rod, respectively.
Figure 23B:
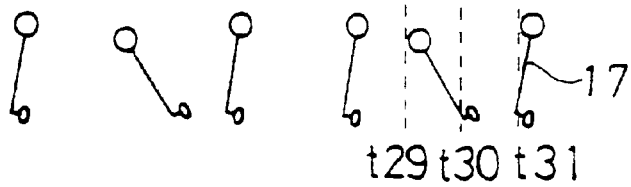

FIGS. 22A and 22B, and FIGS. 23A and 23B, comparatively show effects of presence of a sudden stop offset for suppressing protrusion of the knitting yarn 14 when a knitting operation for one course is completed at a knitting end in each embodiment with regard to yarn speed shown by a solid line and a motor speed shown by a one-dotted chain line. FIGS. 22A and 22B show the case in which the sudden stop offset is not carried out, and FIGS. 23A and 23B show the case in which the sudden stop offset is carried out. FIGS. 22A and 22B, and FIGS. 23A and 23B show a change in yarn speed by a solid line and a change in rotational speed of the servo motor 22 by a one-dotted chain line.

As shown in FIGS. 22A and 22B, even if the servo motor 22 is suddenly stopped at a time t20 at which the knitting operation for one course of the fabric 12 is completed, and the knitting position leaves the knitting end, the servo motor 22 can be stopped only at a time t21 after a constant time passes. Consequently, the knitting yarn 14 is fed until the time t21 that the servo motor 22 is actually stopped, and the amount of the knitting yarn 14 is increased when the yarn speed becomes higher. Also, in the case in which the buffer rod 17 is returned to the limitation of the remainder side range, the knitting yarn 14 shown by dots cannot be absorbed at all. For this reason, the knitting yarn 14 is loosened in a middle of a feeding path so that yarn tension is reduced excessively.

As shown in FIGS. 23A and 23B, when the servo motor 22 is suddenly stopped at a time t29 at which the knitting operation advances to a position of the knitting end at which the knitting operation for one course of the fabric 12 is completed, the knitting end is reached at a time t30. Furthermore, in the case in which supply of the knitting yarn 14 is actually stopped at a time t31, the buffer rod 17 can be used within a proper oscillation range. In particular, it is preferable that the amount of the knitting yarn 14 fed from the time t29 to the time t30 should be equal to that of the knitting yarn 14 fed excessively from the time t30 to the time t31. In the case in which the buffer rod 17 carries out stable control in the vicinity of the origin before the sudden stop at the time t29, and is inclined toward the insufficient side range from the time t29 to the time t30, and the amount shown by a right downward oblique line to fill up shortage of the knitting yarn 14 caused by a reduction in rotation of the servo motor 22 is coincident with the amount shown by a right upward oblique line to absorb excessive knitting yarn 14 from the time t30 to the time t31, the movement of the buffer rod 17 toward the insufficient side is offset against a return toward the origin so that the buffer rod 17 can be stopped in the vicinity of the origin. A difference between the earlier time t29, at which the sudden stop offset is applied, and the time t30, at which the knitting end is reached, is varied depending on the yarn speed.

Although the weft knitting machine 11 has the carriage 29 in each embodiment described above, the invention can also be applied to a weft knitting machine of a carriageless type which has no carriage. In the case in which a mechanism for knitting is a weft knitting machine to be program controlled based on knitting data, it is possible to know a time in which the knitting operation for the fabric 12 is started or ended depending on the mechanism. Thus, pointing of knitting yarn for the yarn feeding apparatus and a sudden stop offset can be carried out properly.

While one yarn feeding apparatus 16 is provided in the side cover 15 on the left side of the weft knitting machine 11 in the description of FIG. 1, it is easy to provide a plurality of yarn feeding apparatuses as described above. Furthermore, it is possible to provide the yarn feeding apparatus 16 in the side cover on the right side in the same manner.

The invention may be embodied in other specific forms without departing from the spirit or essential characteristics thereof. The present embodiments are therefore to be considered in all respects as illustrative and not restrictive, with the scope of the invention being indicated by the appended claims rather than by the foregoing description, and all changes which come within the meaning and the range of equivalency of the claims are therefore intended to be embraced therein.

What is claimed is:

1. A yarn feeding apparatus for feeding knitting yarn to a yarn feeding port of a weft knitting machine depending on demand for the knitting yarn so as to enable a fabric to be knitted by advancing and retreating a knitting needle based on knitting data while the yarn feeding port is moved in a direction of a width of the fabric, comprising:

a main roller provided in a feeding path for the knitting yarn, with a rotatable outer peripheral surface of said main roller adapted to partially come into contact with the knitting yarn;

a servo motor for rotating said main roller;

a driven roller adapted to cooperate with said main roller so as to interpose the knitting yarn, when in contact with the outer peripheral surface of said main roller, between said driven roller and the outer peripheral surface;

a driven mechanism for transmitting a driving force from said servo motor to rotate said driven roller interlockingly with said main roller at a circumferential speed that is equal to that at which said main roller is rotated;

a buffer rod provided in a path through which the knitting yarn is to be fed from between said main roller and said driven roller to the yarn feeding port of the weft knitting machine, said buffer rod having a tip portion that is capable of being rocked and displaced around a base portion of said buffer rod, and said buffer rod being adapted to pull the knitting yarn from the path when the tip portion of said buffer rod is rocked and displaced toward one of two sides;

a spring for urging said buffer rod to one of the two sides so as to pull the knitting yarn, when in the path, from the path by a predetermined length under a predetermined yarn tension;

a sensor for detecting a rocking and displacement state of said buffer rod, based on an origin of the tip portion of said buffer rod, when the knitting yarn is to be pulled from the path by the predetermined length, and for sending a signal indicative of a result of the detection of the rocking and displacement state of said buffer rod; and a controller for proportion, integration and differentiation (PID) control of said servo motor based on the signal sent by said sensor, wherein said controller (i) is to supply, before knitting in the direction of the width of the fabric is started, an amount of the knitting yarn that is greater than that supplied when the tip portion of said buffer rod is positioned at a point corresponding to the origin, (ii) is to perform the PID control to include a differential component within a remainder side range from which the tip portion of said buffer rod is to be returned to the point corresponding to the origin when knitting is started and demand for the knitting yarn is rapidly increased, and (iii) is to perform the PID control so as not to include the differential component even if the tip portion of said buffer rod is on a remainder side or on an insufficient side after the tip portion of said buffer rod once passes through the point corresponding to the origin and is then transferred to within an insufficient side range in which a length of the knitting yarn to be led out from the path is smaller than that to be led out when the tip portion of said buffer rod is at the point corresponding to origin.

2. The yarn feeding apparatus of claim 1, wherein said controller is to perform the PID control based on a change in position of the yarn feeding port with respect to the fabric and a change in amount of the knitting yarn which is calculated from the knitting data such that the rocking and displacement state of said buffer rod is set within a predetermined range.

3. The yarn feeding apparatus of claim 1, wherein said controller to perform, with only the differential component, the PID control so as to include the differential component within a remainder side range, and is to perform, with a proportion component and an integral component, the PID control to include no differential component.

4. The yarn feeding apparatus of claim 1, wherein said controller (i) is to set a gain into a high gain state having an excellent follow-up property while the tip portion of said buffer rod passes from a remainder side range through the point corresponding to the origin and reaches a position at which an amplitude is maximum within and an insufficient side range and then returns toward the point corresponding to the origin to within a predetermined range, and (ii) is to switch the gain into a low gain state having excellent stability while the tip portion of said buffer rod passes through the predetermined range and returns to the point corresponding to the origin.

5. The yarn feeding apparatus of claim 4, wherein said controller is to perform, in the high gain state, the PID control to include no differential component by setting, to be the insufficient side range, a range from which the tip portion of said buffer rod is first moved to the point corresponding to the origin from a position where a large amount of the knitting yarn is supplied before a knitting operation is started by setting said range to be the remainder side range.

6. The yarn feeding apparatus of claim 5, wherein said controller is to perform control for stopping rotation of said servo motor prior to a time at which the knitting yarn is fed to a knitting end where a knitting operation is completed at a side of the fabric in the direction of a width of the fabric such that said servo motor is actually stopped after the knitting yarn is fed to the knitting end, whereby a length of the knitting yarn to be reeled with an inclination of said buffer rod being toward the insufficient side range before the knitting end is passed after a start of the control for stopping rotation of said servo motor is equivalent to a length of the knitting yarn to be stored by return of said buffer rod to the point corresponding the origin before said servo motor is actually stopped after passage of the yarn feeding port through the knitting end.

7. The yarn feeding apparatus of claim 5, wherein said controller is to perform control to increase an amount of feed of the knitting yarn such that a position of the tip portion of said buffer rod is set in the remainder side range apart from the point corresponding to the origin before a knitting operation for a next course is started when it is determined that the yarn feeding port leaves a knitting range in the direction of the width of the fabric based on a change in position of the yarn feeding port with respect to the fabric.

8. The yarn feeding apparatus of claim 5, wherein said controller is to perform control to stop rotation of said servo motor when it is determined that the yarn feeding port is moved away from a knitting yarn feeding side with respect to the width of the fabric based on a change in position of the yarn feeding port with respect to the fabric, and that a position of an advancing and retreating operation of the knitting needle goes beyond an end of the width of the fabric based on the knitting data.

9. The yarn feeding apparatus of claim 5, wherein said controller is to calculate an amount of knitting yarn for each knitting needle.

10. The yarn feeding apparatus of claim 5, wherein said controller is to calculate an amount of knitting yarn for plural knitting needles.

11. The yarn feeding apparatus of claim 1, wherein said controller is to perform control for stopping rotation of said servo motor prior to a time at which the knitting yarn is fed to a knitting end where a knitting operation is completed at a side of the fabric in the direction of a width of the fabric such that said servo motor is actually stopped after the knitting yarn is fed to the knitting end, whereby a length of the knitting yarn to be reeled with an inclination of said buffer rod being toward the insufficient side range before the knitting end is passed after a start of the control for stopping rotation of said servo motor is equivalent to a length of the knitting yarn to be stored by return of said buffer rod to the point corresponding the origin before said servo motor is actually stopped after passage of the yarn feeding port through the knitting end.

12. The yarn feeding apparatus of claim 1, wherein said controller is to perform control to increase an amount of feed of the knitting yarn such that a position of the tip portion of said buffer rod is set in the remainder side range apart from the point corresponding to the origin before a knitting operation for a next course is started when it is determined that the yarn feeding port leaves a knitting range in the direction of the width of the fabric based on a change in position of the yarn feeding port with respect to the fabric.

13. The yarn feeding apparatus of claim 1, wherein said controller is to perform control to stop rotation of said servo motor when it is determined that the yarn feeding port is moved away from a knitting yarn feeding side with respect to the width of the fabric based on a change in position of the yarn feeding port with respect to the fabric, and that a position of an advancing and retreating operation of the knitting needle goes beyond an end of the width of the fabric based on the knitting data.

14. The yarn feeding apparatus of claim 1, wherein said controller is to calculate an amount of knitting yarn for each knitting needle.

15. The yarn feeding apparatus of claim 1, wherein said controller is to calculate an amount of knitting yarn for plural knitting needles.

* * * * *